US011566302B2

(12) United States Patent
Omura et al.

(10) Patent No.: US 11,566,302 B2
(45) Date of Patent: Jan. 31, 2023

(54) GRAIN-ORIENTED ELECTRICAL STEEL SHEET AND METHOD FOR MANUFACTURING SAME

(71) Applicant: JFE STEEL CORPORATION, Tokyo (JP)

(72) Inventors: Takeshi Omura, Tokyo (JP); Hirotaka Inoue, Tokyo (JP); Kunihiro Senda, Tokyo (JP); Seiji Okabe, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 119 days.

(21) Appl. No.: 16/468,087

(22) PCT Filed: Dec. 14, 2017

(86) PCT No.: PCT/JP2017/044989
§ 371 (c)(1),
(2) Date: Jun. 10, 2019

(87) PCT Pub. No.: WO2018/110676
PCT Pub. Date: Jun. 21, 2018

(65) Prior Publication Data

US 2020/0087746 A1 Mar. 19, 2020

(30) Foreign Application Priority Data

Dec. 14, 2016 (JP) ..... JP2016-242451

(51) Int. Cl.
*C21D 9/46* (2006.01)
*C21D 3/04* (2006.01)
(Continued)

(52) U.S. Cl.
CPC ..... *C21D 9/46* (2013.01); *C21D 3/04* (2013.01); *C21D 6/004* (2013.01); *C21D 6/005* (2013.01);
(Continued)

(58) Field of Classification Search
None
See application file for complete search history.

(56) References Cited

U.S. PATENT DOCUMENTS 3,856,568 A 12/1974 Tanaka et al.
5,421,911 A 6/1995 Schoen
(Continued)

FOREIGN PATENT DOCUMENTS

CN 1104507 C 4/2003
CN 101180411 A 5/2008
(Continued)

OTHER PUBLICATIONS

Bib Data and Translation ; JP-2000204450-A; Yamazaki, Shuichi; Jul. 2000 (Year: 2000).*
(Continued)

*Primary Examiner* — Humera N. Sheikh
*Assistant Examiner* — Elizabeth D Ivey
(74) *Attorney, Agent, or Firm* — Kenja IP Law PC

(57) ABSTRACT

Provided is a grain-oriented electrical steel sheet having better transformer iron loss property than conventional grain-oriented electrical steel sheets. A grain-oriented electrical steel sheet comprises: a steel substrate; a forsterite film on a surface of the steel substrate; and a Cr-depleted layer at a boundary between the steel substrate and the forsterite film, the Cr-depleted layer having a Cr concentration that is 0.70 times to 0.90 times a Cr concentration of the steel substrate.

13 Claims, 5 Drawing Sheets

(51) Int. Cl.

| | |
|---|---|
| ***C21D 6/00*** | (2006.01) |
| ***C21D 8/00*** | (2006.01) |
| ***C21D 8/12*** | (2006.01) |
| ***C22C 38/00*** | (2006.01) |
| ***C22C 38/04*** | (2006.01) |
| ***C22C 38/34*** | (2006.01) |
| ***H01F 1/147*** | (2006.01) |
| ***H01F 27/245*** | (2006.01) |
| ***C22C 38/02*** | (2006.01) |
| ***C22C 38/18*** | (2006.01) |
| ***C22C 38/44*** | (2006.01) |
| ***C22C 38/60*** | (2006.01) |
| ***H01F 41/02*** | (2006.01) |

(52) U.S. Cl.

CPC ..... *C21D 6/008* (2013.01); *C21D 8/005* (2013.01); *C21D 8/1255* (2013.01); *C21D 8/1288* (2013.01); *C22C 38/001* (2013.01); *C22C 38/002* (2013.01); *C22C 38/008* (2013.01); *C22C 38/02* (2013.01); *C22C 38/04* (2013.01); *C22C 38/18* (2013.01); *C22C 38/34* (2013.01); *C22C 38/44* (2013.01); *C22C 38/60* (2013.01); *H01F 1/14791* (2013.01); *H01F 27/245* (2013.01); *H01F 41/0233* (2013.01); *C22C 2202/02* (2013.01)

(56) References Cited

U.S. PATENT DOCUMENTS

| | | | | |
|---|---|---|---|---|
| 6,287,392 | B1 | 9/2001 | Toda et al. | |
| 7,887,646 | B2 | 2/2011 | Nanba et al. | |
| 8,900,380 | B2 | 12/2014 | Teraoka et al. | |
| 9,290,824 | B2 | 3/2016 | Watanabe et al. | |
| 9,406,437 | B2 | 8/2016 | Omura et al. | |
| 9,523,620 | B2 | 12/2016 | Otomo et al. | |
| 9,881,720 | B2 | 1/2018 | Schoen et al. | |
| 2013/0098508 | A1* | 4/2013 | Yamaguchi | C21D 8/1266 148/111 |
| 2015/0064481 | A1* | 3/2015 | Schoen | C22C 38/008 428/450 |

FOREIGN PATENT DOCUMENTS

| | | | | | |
|---|---|---|---|---|---|
| CN | 102782170 | A | | 11/2012 | |
| CN | 103069032 | A | | 4/2013 | |
| CN | 103687967 | A | | 3/2014 | |
| CN | 103966522 | A | | 8/2014 | |
| EP | 0987343 | A1 | | 3/2000 | |
| EP | 2602346 | A1 | | 6/2013 | |
| EP | 3039164 | A1 | | 7/2016 | |
| JP | S4839338 | A | | 6/1973 | |
| JP | 2000204450 | A | * | 7/2000 | H01F 1/14783 |
| JP | 2000355717 | A | | 12/2000 | |
| JP | 2001123229 | A | * | 5/2001 | H01F 1/14783 |
| JP | 2001123229 | A | | 5/2001 | |
| JP | 2003166019 | A | | 6/2003 | |
| JP | 2003301271 | A | | 10/2003 | |
| JP | 2004060029 | A | | 2/2004 | |
| JP | 2007239009 | A | | 9/2007 | |
| JP | 2009185324 | A | | 8/2009 | |
| JP | 2012031518 | A | | 2/2012 | |
| JP | 2012214902 | A | | 11/2012 | |
| JP | 2013057119 | A | | 3/2013 | |
| KR | 1020160048151 | A | | 5/2016 | |

OTHER PUBLICATIONS

JP-2001123229-A; Bib Dta and Translation; Toda, Hiroaki; May 2001 (Year: 2001).*

Aug. 4, 2020, Office Action issued by the China National Intellectual Property Administration in the corresponding Chinese Patent Application No. 201780076797.5 with English language search report.

Mar. 20, 2018, International Search Report issued in the International Patent Application No. PCT/JP2017/044989.

Aug. 7, 2019, the Extended European Search Report issued by the European Patent Office in the corresponding European Patent Application No. 17879887.2.

Nov. 24, 2020, Office Action issued by the Korean Intellectual Property Office in the corresponding Korean Patent Application No. 10-2019-7019539 with English language concise statement of relevance.

* cited by examiner

GRAIN-ORIENTED ELECTRICAL STEEL SHEET AND METHOD FOR MANUFACTURING SAME

TECHNICAL FIELD

The present disclosure relates to a grain-oriented electrical steel sheet and a method for manufacturing the same. The present disclosure particularly relates to a grain-oriented electrical steel sheet suitable for an iron core material of a wound core type transformer, and a method for manufacturing the same.

BACKGROUND

The iron loss (transformer iron loss) of a grain-oriented electrical steel sheet in a state of being assembled in a transformer is inevitably higher than the iron loss (product sheet iron loss) of the grain-oriented electrical steel sheet in a state of being a product sheet. The proportion of this iron loss increase is called a building factor. The iron loss increase is caused by processing strain introduced during transformer assembly, rotating magnetic flux which does not occur in evaluation of product sheet iron loss, and the like.

To remove processing strain, the manufacture of the wound core type transformer includes stress relief annealing. The annealing temperature in the stress relief annealing is preferably higher, for strain removal. The annealing atmosphere is preferably a Ar or $H_2$ atmosphere that does not react with the steel sheet to form oxide, carbide, nitride, or the like. However, since the use of Ar or $H_2$ is costly, $N_2$ gas or DX gas containing CO or $CO_2$ is used in many cases. In the case of using $N_2$ gas or DX gas, if the annealing temperature is excessively high, nitriding, oxidizing, or carburizing occurs, which degrades magnetic property. The annealing temperature thus has a substantial upper limit. This makes the removal of processing strain insufficient and hinders maximum use of favorable properties of the product sheet in some cases.

A tension coating mainly composed of colloidal silica, phosphate, and chromic acid is typically formed on a grain-oriented electrical steel sheet, as described in JP S48-39338 A (PTL 1). Such a tension coating is highly protective against atmosphere gas and suppresses gas permeation as described in JP 2003-301271 A (PTL 2), and therefore contributes to prevention of nitriding/oxidizing/carburizing in stress relief annealing to some extent.

CITATION LIST

Patent Literatures

PTL 1: JP S48-39338 A
PTL 2: JP 2003-301271 A

SUMMARY

Technical Problem

However, the extent to which nitriding/oxidizing/carburizing is suppressed is insufficient, and nitriding/oxidizing/carburizing needs to be further suppressed.

It could therefore be helpful to provide a grain-oriented electrical steel sheet having better transformer iron loss property than conventional grain-oriented electrical steel sheets as a result of suppressing nitriding/oxidizing/carburizing even in a temperature range in which strain is completely removed in stress relief annealing performed in manufacture of a wound core type transformer, and a method for manufacturing the same.

Solution to Problem

A typical grain-oriented electrical steel sheet has a forsterite film formed thereon. Although this film was considered to be also effective in suppressing nitriding/oxidizing/carburizing in stress relief annealing, SEM observation on the surface of the forsterite film revealed that the forsterite film has many cracks on its surface and nitriding/oxidizing/carburizing gas reaches the steel sheet surface through the cracks and induces a nitriding/oxidizing/carburizing reaction. The cracks of the forsterite film are caused by tension applied for shape adjustment in flattening annealing or in-coil stress resulting from non-uniform in-coil temperature during cooling in secondary recrystallization annealing. The cracks caused by such factors cannot be completely eliminated by existing grain-oriented electrical steel sheet manufacturing methods.

In view of this, we studied whether the cracks of the forsterite film can be used to supply an oxidizing source to the interface between the forsterite film and the steel substrate to newly form a dense Cr-based oxide film at the interface and suppress nitriding/oxidizing/carburizing by the oxide film. We consequently discovered that, by performing appropriate oxidizing treatment to form an oxide film at the interface between the forsterite film and the steel substrate after performing final annealing and removing any unreacted separator and before forming a tension coating on the steel sheet, oxidizing/nitriding/carburizing in stress relief annealing can be suppressed without degradation in other properties.

That is, primary features of a grain-oriented electrical steel sheet that resists oxidizing/nitriding/carburizing in stress relief annealing and a method for manufacturing the same, which were discovered from the below-described experimental results, are as follows:

1) A Cr-depleted layer is present at the boundary between a forsterite film and a steel substrate, and the Cr concentration of the depleted layer and the Cr concentration of the steel substrate satisfy the following formula:

$$0.70 \leq (\text{the Cr concentration of the Cr-depleted layer})/(\text{the Cr concentration of the steel substrate}) \leq 0.90.$$

2) The steel substrate contains, in mass %, Cr: 0.02% or more and 0.20% or less.

3) To obtain the Cr-depleted layer without degrading other properties, a continuous sheet passing process is performed with an appropriate combination of temperature and oxidizability of atmosphere, after final annealing and removal of any unreacted separator and before formation of a tension coating.

4) In particular, to suppress variation of the appropriate oxidizability of atmosphere depending on manufacturing conditions, the continuous sheet passing process is performed in a pass line including at least one part that imparts bending in a direction opposite to a curl in coil set (residual curvature) which occurs in the steel sheet when annealed in coil form, between the final annealing and the Cr-depleted layer formation treatment.

How we conceived the presently disclosed technology will be described in detail below. First, we considered that an effective way of suppressing nitriding/oxidizing/carburizing in stress relief annealing is to form a dense oxide film between the forsterite film and the steel substrate. We examined forming the dense oxide film after the forsterite film formation.

<Experiment 1>

A steel slab having a composition containing, in mass %, C: 0.075%, Si: 3.45%, Mn: 0.020%, P: 0.01%, S: 0.004%, Al: 0.026%, Se: 0.022%, N: 0.0070%, and Cr: 0.10% with the balance being Fe and inevitable impurities was heated at 1400° C., then hot rolled to form a hot-rolled sheet with a sheet thickness of 2.3 mm, and then subjected to hot band annealing at 1100° C. for 80 sec. The steel sheet was then cold rolled to a sheet thickness of 0.20 mm, and subjected to decarburization annealing in an oxidizing atmosphere: $PH_2O/PH_2$=0.35 at 850° C. for 2 min. After this, MgO in slurry form was applied to the steel sheet surface as an annealing separator. The steel sheet was then subjected to final annealing intended for secondary recrystallization and purification, at 1250° C. for 30 hr in a $H_2$ atmosphere.

Following this, to form an oxide film at the interface between the forsterite film and the steel substrate, any unreacted separator was removed, and continuous annealing of 200° C. to 700° C. was performed in the air. In the continuous annealing, the steel sheet was passed while applying a tension (line tension) of 0.5 kgf/mm$^2$ to 3.0 kgf/mm$^2$ (4.9 MPa to 29.4 MPa). Although sheet passing at less than 0.5 kgf/mm$^2$ (4.9 MPa) was attempted, the sheet passing failed because of low shape adjustment ability. Lastly, an insulation coating containing 50% of colloidal silica and magnesium phosphate was applied, to obtain a product sheet. The product sheet was then used to produce a wound core, and the wound core was subjected to stress relief annealing in a $N_2$ atmosphere at 865° C. for 3 hr. The ratio between the wound core iron loss $W_{17/50}$ (1.7 T, 50 Hz) and the product sheet iron loss $W_{17/50}$, the nitriding quantity, the resistance to coating exfoliation, the sheet passing property, and the product sheet property were evaluated.

In detail, the nitrogen content in the steel substrate before and after the stress relief annealing was measured by the spectrophotometry defined in "Iron and steel-Methods for determination of nitrogen content" in JIS G 1228-1997, and the difference between before and after the stress relief annealing was taken to be the nitriding quantity.

The iron loss ratio between the product sheet and the wound core was calculated by dividing the iron loss of the wound core by the iron loss of the product sheet. For the iron loss of the product sheet, Epstein test pieces were collected from the product sheet and measured in accordance with JIS C 2550. For the iron loss of the wound core, a primary coil and a secondary coil were wound around the produced core to form an unloaded transformer, and the AC magnetic property of the unloaded transformer was measured by the same method as the Epstein test in accordance with JIS C 2550.

For the resistance to coating exfoliation, the steel sheet was wound around a rod and whether coating exfoliation occurred was determined. The rod diameter was gradually reduced, and a diameter immediately before exfoliation occurred (coating exfoliation diameter) was taken to be an evaluation parameter for the resistance to coating exfoliation. A smaller value indicates higher resistance to coating exfoliation. The rod diameter was changed with a 5 mm pitch.

The sheet passing property was evaluated based on meander quantity, where 10 mm or less was rated "excellent", more than 10 mm and less than 30 mm was rated "good", and 30 mm or more was rated "poor".

The product sheet property was evaluated using two parameters: the iron loss ratio and the resistance to coating exfoliation. Each of the iron loss ratio and the resistance to coating exfoliation was rated "excellent", "good", or "poor" as described below, and one of the two parameters with a lower rating was used to determine the product sheet property.

The evaluation results are shown in Table 1. As the resistance to coating exfoliation, 30 mmϕ or less was rated "excellent", more than 30 mmϕ and less than 50 mmϕ was rated "good", and 50 mmϕ or more was rated "poor". As the iron loss ratio, 1.05 or less was rated "excellent", more than 1.05 and less than 1.10 was rated "good", and 1.10 or more was rated "poor". The product sheet property varied depending on the continuous annealing conditions (temperature, tension). For example, Nos. 6, 8, 10, 11, and 13 were very favorable in both of the iron loss property and the resistance to coating exfoliation. Nos. 1, 2, 3, 4, 5, and 7 tended to be favorable in the resistance to coating exfoliation but inferior in the iron loss property. Nos. 9, 12, 14, 15, 16, 17, and 18 tended to be favorable in the iron loss property but inferior in the resistance to coating exfoliation.

TABLE 1

| Sample No. | Annealing temperature (° C.) | Line tension (kgf/mm$^2$) | Nitriding quantity (ppm) | Iron loss ratio (wound core iron loss/ product sheet iron loss) | Resistance to coating exfoliation (mmϕ) | Sheet passing property | Product sheet property |
|---|---|---|---|---|---|---|---|
| 1 | 200 | 0.5 | 60 | 1.15 | 20 | Good | Poor |
| 2 | 200 | 1.5 | 60 | 1.15 | 20 | Excellent | Poor |
| 3 | 200 | 2.5 | 60 | 1.15 | 20 | Excellent | Poor |
| 4 | 300 | 0.5 | 60 | 1.15 | 20 | Good | Poor |
| 5 | | 1.5 | 30 | 1.08 | 20 | Excellent | Good |
| 6 | | 2.5 | 2 | 1.03 | 30 | Excellent | Excellent |
| 7 | 400 | 0.6 | 30 | 1.08 | 20 | Good | Good |
| 8 | | 1.6 | 5 | 1.04 | 20 | Excellent | Excellent |
| 9 | | 2.6 | 5 | 1.03 | 40 | Excellent | Good |
| 10 | 500 | 0.6 | 15 | 1.04 | 20 | Good | Excellent |
| 11 | | 1.8 | 10 | 1.03 | 30 | Excellent | Excellent |
| 12 | | 3.0 | 5 | 1.03 | 40 | Excellent | Good |
| 13 | 600 | 0.6 | 10 | 1.04 | 20 | Good | Excellent |
| 14 | | 1.3 | 2 | 1.03 | 40 | Excellent | Good |
| 15 | | 2.4 | 2 | 1.03 | 50 | Excellent | Poor |
| 16 | 700 | 0.7 | 2 | 1.03 | 60 | Excellent | Poor |
| 17 | | 1.5 | 2 | 1.04 | 70 | Excellent | Poor |
| 18 | | 2.8 | 2 | 1.03 | 80 | Excellent | Poor |

Next, to investigate whether the oxide film is present at the interface between the forsterite film and the steel substrate, we conducted surface analysis on the foregoing sample using a glow discharge emission spectroscopy (GDS) device. As a result of searching for a GDS parameter that correlates with the nitriding quantity and the iron loss ratio, a correlation was found between the Cr concentration ratio of a Cr-depleted layer to the steel substrate and each of the nitriding quantity, the iron loss ratio, and the resistance to coating exfoliation, as illustrated in FIGS. 1 to 3. In detail, when the Cr concentration ratio of the Cr-depleted layer to the steel substrate was more than 0.9, the nitriding quantity increased, and the iron loss ratio increased responsively, as illustrated in FIGS. 1 and 2. Meanwhile, the resistance to coating exfoliation had a tendency that the exfoliation diameter increased when the Cr concentration ratio of the Cr-depleted layer to the steel substrate was less than 0.7, as illustrated in FIG. 3.

The Cr concentration ratio of the Cr-depleted layer to the steel substrate is defined as follows.

FIG. 4 illustrates an example of a Cr intensity profile in GDS. As illustrated in the drawing, there is a region (inside the steel substrate) in which the profile intensity assumes a constant value B and a region (Cr-depleted layer) in which the Cr intensity is lower than the constant value B. The ratio of the lowest Cr intensity A in the Cr-depleted layer to the Cr intensity B inside the steel substrate was taken to be the Cr concentration ratio of the Cr-depleted layer to the steel substrate. The reason that the Cr concentration ratio of the Cr-depleted layer of the steel substrate surface layer to the steel substrate correlates with each of the nitriding quantity, the iron loss ratio, and the resistance to coating exfoliation is considered to be the following.

As illustrated in FIG. 4, Cr shows an oxidizing reaction during forsterite formation in the secondary recrystallization annealing, and is present as an oxide in forsterite. Hence, the intensity increases with the change from the steel substrate to the forsterite film. In the case where the secondary recrystallization annealing that forms the forsterite film is performed in batch annealing, the annealing time is several ten hours, so that the diffusion of Cr from inside the steel substrate is fully possible and no Cr-depleted layer is likely to form. In the case where the annealing is performed continuously in a short time as in the present case, on the other hand, the diffusion time is short, so that the Cr-depleted layer forms. The Cr-depleted layer can thus be regarded as an index for determining whether the dense Cr-based oxide layer is newly formed at the interface between the forsterite film and the steel substrate.

Therefore, the reason that the nitriding quantity was reduced and the iron loss ratio increase was reduced when the Cr concentration ratio of the Cr-depleted layer to the steel substrate was 0.9 or less is considered to be because the dense Cr-based oxide film was newly formed at the interface between the forsterite film and the steel substrate as a result of the continuous annealing treatment. Meanwhile, the reason that the exfoliation diameter increased when the Cr concentration ratio of the Cr-depleted layer to the steel substrate was less than 0.7 is considered to be because the oxide film was excessively thick and the adhesion at the interface between the steel substrate and the oxide film decreased, leading to exfoliation.

The reason that the iron loss ratio changed depending on the line tension is considered to be because the atmosphere gas reaching the interface with the steel substrate changed due to the difference in the proportion of introduction of cracks in the forsterite film. The reason that the iron loss ratio changed depending on the annealing temperature is considered to be because the oxidizing reaction (rate, product) changed depending on the temperature.

An annealing temperature of less than 300° C. and more than 600° C. was not a favorable condition. This is considered to be because, given that oxidation is hindered at low temperatures and facilitated at high temperatures, the Cr-depleted layer was not able to be controlled to the desired range even when the conditions other than the annealing temperature were adjusted. Accordingly, the temperature of the treatment for forming the dense oxide film at the interface between the forsterite film and the steel substrate is set to 300° C. to 600° C.

The results illustrated in FIGS. 1 to 4 demonstrate that there are appropriate conditions for the new oxide film formed at the interface between the forsterite film and the steel substrate. Specifically, the Cr concentration ratio of the Cr-depleted layer to the steel substrate needs to be 0.7 or more and 0.9 or less.

Thus, we found out that (1) the use of Cr oxide is very effective, (2) the line tension influences the formation of the Cr-depleted layer, and (3) the annealing temperature is also an important control factor. In addition, we further studied the influences of the Cr content, the Si content, and the oxidizability of atmosphere in decarburization annealing that controls the forsterite film formation state, as factors that can influence the oxidizing reaction.

<Experiment 2>

A steel slab having a composition containing, in mass %, C: 0.075%, Si: 2.85% to 3.45%, Mn: 0.020%, P: 0.01%, S: 0.004%, Al: 0.026%, Se: 0.022%, N: 0.0075%, and Cr: 0.01% to 0.10% with the balance being Fe and inevitable impurities was heated at 1450° C., then hot rolled to form a hot-rolled sheet with a sheet thickness of 2.6 mm, and then subjected to hot band annealing at 1100° C. for 80 sec. The steel sheet was then cold rolled to a sheet thickness of 0.25 mm, and subjected to decarburization annealing in an oxidizing atmosphere: $PH_2O/PH_2$=0.25 to 0.45 at 850° C. for 2 min.

After this, MgO in slurry form was applied to the steel sheet surface as an annealing separator. The steel sheet was then subjected to final annealing intended for secondary recrystallization and purification, at 1200° C. for 15 hr in a $H_2$ atmosphere. After removing any unreacted separator, tension coating baking treatment also serving as flattening annealing was performed. In a temperature range of 400° C. to 550° C. as the heating temperature in a heating process in this tension coating baking treatment, i.e. a drying and baking process after applying a coating liquid, a $H_2$—$N_2$ atmosphere was used, and the dew point was controlled to set the oxygen partial pressure to 0.1 atm. The line tension during sheet passing in the temperature range of 400° C. to 550° C. was 0.7 kgf/mm$^2$ (6.9 MPa).

The product sheet produced in the above-described manner was then used to produce a wound core, and the wound core was subjected to stress relief annealing in a $N_2$ atmosphere at 850° C. for 10 hr. The ratio between the wound core iron loss $W_{17/50}$ (1.7 T, 50 Hz) and the product sheet iron loss $W_{17/50}$, the Cr concentration ratio of the Cr-depleted layer to the steel substrate, the nitriding quantity, the resistance to coating exfoliation, and the sheet passing property were evaluated. The results are shown in Table 2. The resistance to coating exfoliation, the iron loss ratio, the product sheet property, and the sheet passing property were evaluated in the same way as in Experiment 1.

As can be seen from Nos. 1 to 4 in Table 2, even in the case where the oxidizing treatment conditions were the same, the Cr concentration ratio of the Cr-depleted layer to the steel substrate varied if the Si content was different. The reason that the Cr concentration ratio of the Cr-depleted layer to the steel substrate increased with an increase of the Si content is considered to be because oxygen was also used in reaction with Si and accordingly its reaction with Cr was reduced. As can be seen from Nos. 5 to 8 in Table 2, the Cr concentration ratio of the Cr-depleted layer to the steel substrate also varied depending on the Cr content. When the Cr content was higher, the Cr concentration ratio of the Cr-depleted layer to the steel substrate was lower, and a Cr-depleted layer with a lower Cr concentration was easily formed. As can be seen from Nos. 9 to 12 in Table 2, the Cr concentration ratio of the Cr-depleted layer to the steel substrate varied if the oxidizing atmosphere in the decarburization annealing was different.

Here, to suppress nitriding/oxidizing/carburizing by supplying an oxidizing source to the interface between the forsterite film and the steel substrate and newly form a dense oxide film at the interface, we focused attention on Cr that can form a dense passive film and considerably improve the corrosion resistance.

The oxidizing atmosphere in the decarburization annealing is a factor that influences the formation of the forsterite film. There is a tendency that the film thickness is thinner and the quality is lower when the oxidizing atmosphere is lower. It is thus considered that, depending on the oxidizability of atmosphere, the quality of the forsterite film changes and the frequency of cracking of the forsterite film caused by the line tension or the like changes, which resulted in the difference in the Cr concentration ratio of the Cr-depleted layer to the steel substrate.

As is clear from these results, the factors that influence the forsterite formation and the factors that influence the oxidizing reaction influence the Cr concentration ratio of the Cr-depleted layer to the steel substrate. It was thus revealed that the annealing conditions for forming a dense oxide film (the Cr concentration ratio of the Cr-depleted layer to the steel substrate: 0.7 or more and 0.9 or less) at the interface between the forsterite film and the steel substrate without influencing the other properties do not have a specific suitable range but need to be adjusted according to the manufacturing conditions (the combination of influential factors) each time.

Next, we studied the influence of the oxidizing atmosphere when forming the dense oxide film.

<Experiment 3>

A steel slab having a composition containing, in mass %, C: 0.02%, Si: 3.0%, Mn: 0.050%, P: 0.07%, S: 0.002%, Al: 0.007%, Se: 0.001%, N: 0.0050%, and Cr: 0.06% with the balance being Fe and inevitable impurities was heated at 1200° C., then hot rolled to form a hot-rolled sheet with a sheet thickness of 2.6 mm, and then subjected to hot band annealing at 1050° C. for 80 sec. The steel sheet was then cold rolled to a sheet thickness of 0.23 mm, and subjected to decarburization annealing in an oxidizing atmosphere: $PH_2O/PH_2$=0.40 at 850° C. for 2 min. After this, MgO in slurry form was applied to the steel sheet surface as an annealing separator. The steel sheet was then subjected to final annealing intended for secondary recrystallization and purification, at 1180° C. for 75 hr in a $H_2$ atmosphere.

Following this, any unreacted separator was removed, and tension coating baking treatment also serving as flattening annealing was performed. In each of the temperature ranges: (1) 350° C. or less, (2) more than 350° C. and 450° C. or less, (3) more than 450° C. and 600° C. or less, and (4) more than 600° C. and 800° C. or less as the heating temperature in a heating process in this tension coating baking treatment, i.e. a drying and baking process after applying a coating liquid, the partial pressure of each component gas in a DX gas atmosphere ($CO_2$, CO, $H_2$, $H_2O$, and the balance being $N_2$) was controlled to change the oxygen partial pressure in a range of 0.005 to 0.4. The line tension during sheet passing in each of the temperature ranges was 0.7 kgf/mm$^2$ (6.9 MPa).

The product sheet produced in the above-described manner was then used to produce a wound core, and the wound core was subjected to stress relief annealing in a DX gas atmosphere ($CO_2$: 15%, CO: 3%, $H_2$: 0.5%, and the balance being $N_2$, dew point: 30° C.) at 860° C. for 5 hr. The ratio between the wound core iron loss $W_{17/50}$ (1.7 T, 50 Hz) and the product sheet iron loss $W_{17/50}$, the Cr concentration ratio of the Cr-depleted layer to the steel substrate, the nitriding quantity, the carburizing quantity, the resistance to coating exfoliation, the sheet passing property, and the product sheet property were evaluated. In detail, the carbon content in the steel substrate before and after the stress relief annealing was measured by the infrared absorption method defined in "Iron and steel-Determination of carbon content" in JIS G

TABLE 2

| Sample No. | Si content (mass %) | Cr content (mass %) | Oxidizability of atmosphere in decarburization annealing | Cr concentration ratio of Cr-depleted layer to steel substrate | Nitriding quantity (ppm) | Iron loss ratio (wound core iron loss/ product sheet iron loss) | Resistance to coating exfoliation (mmϕ) | Sheet passing property | Product sheet property |
|---|---|---|---|---|---|---|---|---|---|
| 1 | 2.85 | 0.01 | 0.40 | 0.75 | 2 | 1.02 | 30 | Excellent | Excellent |
| 2 | 3.05 | 0.01 | 0.40 | 0.80 | 7 | 1.02 | 20 | Excellent | Excellent |
| 3 | 3.25 | 0.01 | 0.40 | 0.91 | 28 | 1.08 | 20 | Excellent | Good |
| 4 | 3.45 | 0.01 | 0.40 | 0.98 | 50 | 1.13 | 20 | Excellent | Poor |
| 5 | 3.55 | 0.01 | 0.30 | 0.98 | 55 | 1.13 | 20 | Excellent | Poor |
| 6 | 3.55 | 0.09 | 0.30 | 0.87 | 8 | 1.04 | 20 | Excellent | Excellent |
| 7 | 3.55 | 0.15 | 0.30 | 0.8 | 0 | 1.01 | 30 | Excellent | Excellent |
| 8 | 3.55 | 0.25 | 0.30 | 0.73 | 0 | 1.01 | 30 | Excellent | Excellent |
| 9 | 3.3 | 0.05 | 0.25 | 0.79 | 2 | 1.01 | 30 | Excellent | Excellent |
| 10 | 3.3 | 0.05 | 0.32 | 0.83 | 2 | 1.02 | 30 | Excellent | Excellent |
| 11 | 3.3 | 0.05 | 0.38 | 0.86 | 10 | 1.04 | 20 | Excellent | Excellent |
| 12 | 3.3 | 0.05 | 0.45 | 0.93 | 35 | 1.10 | 20 | Excellent | Poor |

1211-2011, and the difference between before and after the stress relief annealing was taken to be the carburizing quantity. The resistance to coating exfoliation, the iron loss ratio, the product sheet property, and the sheet passing property were evaluated in the same way as in Experiment 1.

The results are shown in Table 3. As can be understood from Table 3, the appropriate Cr concentration ratio of the Cr-depleted layer to the steel substrate changes depending on the temperature and the oxidizability of atmosphere which are the dense oxide film treatment conditions, and the Cr concentration ratio of the Cr-depleted layer to the steel substrate can be controlled to the appropriate condition by adjusting the oxidizability of atmosphere according to the individual manufacturing conditions. At more than 600° C., the Cr concentration ratio of the Cr-depleted layer to the steel substrate could not be controlled. This is considered to be because, at more than 600° C., the formation of the insulating coating was approximately complete and therefore oxygen was unable to reach the interface between the steel substrate and the forsterite film.

TABLE 3

| Sample No. | Treatment temperature range | Oxygen partial pressure in oxide film formation treatment (atm) | Cr concentration ratio of Cr-depleted layer to steel substrate | Nitriding quantity (ppm) | Carburizing quantity (ppm) | Iron loss ratio (wound core iron loss/ product sheet iron loss) | Resistance to coating exfoliation (mmϕ) | Sheet passing property | Product sheet property |
|---|---|---|---|---|---|---|---|---|---|
| 1 | 350° C. | 0.005 | 1.00 | 40 | 65 | 1.26 | 20 | Excellent | Poor |
| 2 | or less | 0.01 | 1.00 | 40 | 65 | 1.26 | 20 | Excellent | Poor |
| 3 | | 0.05 | 1.00 | 40 | 65 | 1.26 | 20 | Excellent | Poor |
| 4 | | 0.1 | 0.98 | 30 | 45 | 1.21 | 20 | Excellent | Poor |
| 5 | | 0.2 | 0.92 | 20 | 30 | 1.09 | 20 | Excellent | Good |
| 6 | | 0.3 | 0.86 | 5 | 10 | 1.04 | 20 | Excellent | Excellent |
| 7 | | 0.4 | 0.82 | 0 | 5 | 1.01 | 20 | Excellent | Excellent |
| 8 | More than | 0.005 | 1.00 | 42 | 63 | 1.25 | 20 | Excellent | Poor |
| 9 | 350° C. and | 0.01 | 0.96 | 35 | 55 | 1.22 | 20 | Excellent | Poor |
| 10 | 450° C. | 0.05 | 0.93 | 29 | 48 | 1.19 | 20 | Excellent | Poor |
| 11 | or less | 0.1 | 0.91 | 27 | 44 | 1.1 | 20 | Excellent | Poor |
| 12 | | 0.2 | 0.86 | 0 | 2 | 1.02 | 30 | Excellent | Excellent |
| 13 | | 0.3 | 0.82 | 0 | 2 | 1.02 | 30 | Excellent | Excellent |
| 14 | | 0.4 | 0.79 | 0 | 2 | 1.02 | 30 | Excellent | Excellent |
| 15 | More than | 0.005 | 0.95 | 40 | 60 | 1.25 | 20 | Excellent | Poor |
| 16 | 450° C. and | 0.01 | 0.92 | 29 | 45 | 1.21 | 20 | Excellent | Poor |
| 17 | 600° C. | 0.05 | 0.84 | 3 | 8 | 1.05 | 20 | Excellent | Excellent |
| 18 | or less | 0.1 | 0.76 | 0 | 2 | 1.03 | 30 | Excellent | Excellent |
| 19 | | 0.2 | 0.72 | 0 | 2 | 1.03 | 30 | Excellent | Excellent |
| 20 | | 0.3 | 0.65 | 0 | 2 | 1.03 | 45 | Excellent | Good |
| 21 | | 0.4 | 0.57 | 0 | 2 | 1.03 | 60 | Excellent | Poor |
| 22 | More than | 0.005 | 1.00 | 38 | 60 | 1.22 | 20 | Excellent | Poor |
| 23 | 600° C. and | 0.01 | 1.00 | 41 | 65 | 1.23 | 20 | Excellent | Poor |
| 24 | 800° C. | 0.05 | 1.00 | 40 | 62 | 1.22 | 20 | Excellent | Poor |
| 25 | or less | 0.1 | 1.00 | 39 | 60 | 1.22 | 20 | Excellent | Poor |
| 26 | | 0.2 | 1.00 | 39 | 58 | 1.23 | 20 | Excellent | Poor |
| 27 | | 0.3 | 1.00 | 40 | 60 | 1.22 | 20 | Excellent | Poor |
| 28 | | 0.4 | 1.00 | 40 | 62 | 1.22 | 20 | Excellent | Poor |

By forming the new dense oxide layer at the interface between the forsterite film and the steel substrate after performing the final annealing and removing any unreacted separator and before applying the tension coating, in stress relief annealing which is performed in many wound core manufacturing processes, nitriding/carburizing/oxidizing from the annealing atmosphere can be suppressed. By controlling the state of the oxide film formed here, degradation of the iron loss property of the wound core can be prevented without degrading other properties.

These results demonstrate that the Cr concentration ratio of the Cr-depleted layer to the steel substrate can be controlled to the appropriate range by adjusting the oxidizability of atmosphere according to individual manufacturing conditions. Since the manufacturing conditions vary inevitably, it is very significant to, in the adjustment of the oxidizability of atmosphere, reduce the dependence of the oxidizability of atmosphere on the manufacturing conditions, for stable manufacture of the grain-oriented electrical steel sheet. The foregoing studies suggest that it is important to supply sufficient oxygen from the steel sheet surface to the interface between the steel substrate and the forsterite film, in order to form the dense oxide layer at the interface. In the case where the supply amount of oxygen is low, the reaction with Cr does not proceed sufficiently at low temperature, and a desired film is not formed. In the case where the supply amount of oxygen is high, the reaction proceeds even at low temperature, and a desired film is formed.

Next, we studied how to stably ensure the supply amount of oxygen from the surface. Oxygen passes through the forsterite film and reaches the interface. Accordingly, the density of the forsterite film is a very important parameter. The density greatly depends on the manufacturing conditions such as the oxidizability of atmosphere in the decarburization annealing and the amount of MgO applied in slurry form, and therefore its state after the completion of the final annealing varies considerably. We conducted research on how to reduce this variation. The final annealing is performed in coil form, and accordingly coil set (residual curvature) occurs after the annealing. When the steel sheet is bent in the direction opposite to the coil set, tensile stress is applied to one side of the steel sheet and compressive stress is applied to the other side of the steel sheet. We attempted to introduce appropriate cracks to the forsterite film by such tensile stress and compressive stress.

<Experiment 4>

A steel slab having a composition containing, in mass %, C: 0.075%, Si: 2.85% to 3.45%, Mn: 0.020%, P: 0.01%, S: 0.004%, Al: 0.026%, Se: 0.022%, N: 0.0075%, and Cr: 0.01% to 0.10% with the balance being Fe and inevitable impurities was heated at 1450° C., then hot rolled to form a hot-rolled sheet with a sheet thickness of 2.6 mm, and then subjected to hot band annealing at 1100° C. for 80 sec. The steel sheet was then cold rolled to a sheet thickness of 0.25 mm, and subjected to decarburization annealing in an oxidizing atmosphere: $PH_2O/PH_2$=0.25 to 0.45 at 850° C. for 2 min.

After this, MgO in slurry form was applied to the steel sheet surface as an annealing separator. The steel sheet was then subjected to final annealing intended for secondary recrystallization and purification, at 1200° C. for 15 hr in a $H_2$ atmosphere. The final annealing was performed on the steel sheet wounded in a coil. Subsequently, after removing any unreacted separator, tension coating baking treatment also serving as flattening annealing was performed. In a temperature range of 400° C. to 550° C. as the heating temperature in a heating process in this tension coating baking treatment, i.e. a drying and baking process after applying a coating liquid, sheet passing was performed in a DX gas atmosphere ($CO_2$, CO, $H_2$, $H_2O$, and the balance being $N_2$) with an oxygen partial pressure of 0.1 atm. The line tension during sheet passing in the temperature range of 400° C. to 550° C. was 0.7 kgf/mm$^2$ (6.9 MPa).

As illustrated in FIG. 5, the sheet passing was performed in each of a pattern I including a part that imparts bending in the direction opposite to the coil set after the final annealing and a pattern II including no bending part, at a tension of 0.7 kgf/mm$^2$ (6.9 MPa). Specifically, in the pattern I, two rollers of 700 mmϕ were installed and the second roller imparts bending in the direction opposite to the coil set, as illustrated in FIG. 5.

The product sheet produced in the above-described manner was then used to produce a wound core, and the wound core was subjected to stress relief annealing in a $N_2$ atmosphere at 850° C. for 10 hr. The ratio between the wound core iron loss $W_{17/50}$ (1.7 T, 50 Hz) and the product sheet iron loss $W_{17/50}$, the Cr concentration ratio of the Cr-depleted layer to the steel substrate, the nitriding quantity, the resistance to coating exfoliation, and the sheet passing property were evaluated. The results are shown in Table 4. The resistance to coating exfoliation, the iron loss ratio, the product sheet property, and the sheet passing property were evaluated in the same way as in Experiment 1.

In the case of the sheet passing in the pattern I, there was no dependence of the Cr concentration ratio of the Cr-depleted layer to the steel substrate on the manufacturing conditions. In the case of the sheet passing in the pattern II, there was the dependence on the manufacturing conditions. The reason that there was no dependence on the manufacturing conditions in the pattern I is considered to be because, as a result of applying high tensile and compressive stress to the steel sheet surface before the oxide film formation, the difference in the density of the forsterite film that changes depending on the manufacturing conditions was reduced, and sufficient oxygen was supplied.

TABLE 4

| Sample No. | Si content (mass %) | Cr content (mass %) | Oxidizability of atmosphere in decarburization annealing | Sheet passing pattern | Cr concentration ratio of Cr-depleted layer to steel substrate | Nitriding quantity (ppm) | Iron loss ratio (wound core iron loss/ product sheet iron loss) | Resistance to coating exfoliation (mmϕ) | Sheet passing property | Product sheet property |
|---|---|---|---|---|---|---|---|---|---|---|
| 1 | 2.85 | 0.01 | 0.40 | I | 0.75 | 0 | 1.02 | 30 | Excellent | Excellent |
| 2 | 3.05 | 0.01 | 0.40 | | 0.75 | 0 | 1.02 | 20 | Excellent | Excellent |
| 3 | 3.25 | 0.01 | 0.40 | | 0.75 | 0 | 1.02 | 20 | Excellent | Excellent |
| 4 | 3.45 | 0.01 | 0.40 | | 0.75 | 0 | 1.02 | 20 | Excellent | Excellent |
| 5 | 3.55 | 0.01 | 0.30 | | 0.75 | 0 | 1.02 | 20 | Excellent | Excellent |
| 6 | 3.55 | 0.09 | 0.30 | | 0.75 | 0 | 1.02 | 20 | Excellent | Excellent |
| 7 | 3.55 | 0.15 | 0.30 | | 0.75 | 0 | 1.02 | 30 | Excellent | Excellent |
| 8 | 3.55 | 0.25 | 0.30 | | 0.75 | 0 | 1.02 | 30 | Excellent | Excellent |
| 9 | 3.3 | 0.05 | 0.25 | | 0.75 | 0 | 1.02 | 30 | Excellent | Excellent |
| 10 | 3.3 | 0.05 | 0.32 | | 0.75 | 0 | 1.02 | 30 | Excellent | Excellent |
| 11 | 3.3 | 0.05 | 0.38 | | 0.75 | 0 | 1.02 | 20 | Excellent | Excellent |
| 12 | 3.3 | 0.05 | 0.45 | | 0.75 | 0 | 1.02 | 20 | Excellent | Excellent |
| 13 | 2.85 | 0.01 | 0.40 | H | 0.75 | 2 | 1.02 | 30 | Excellent | Excellent |
| 14 | 3.05 | 0.01 | 0.40 | | 0.8 | 7 | 1.02 | 20 | Excellent | Excellent |
| 15 | 3.25 | 0.01 | 0.40 | | 0.91 | 28 | 1.08 | 20 | Excellent | Good |
| 16 | 3.45 | 0.01 | 0.40 | | 0.98 | 50 | 1.13 | 20 | Excellent | Poor |
| 17 | 3.55 | 0.01 | 0.30 | | 0.98 | 55 | 1.13 | 20 | Excellent | Poor |
| 18 | 3.55 | 0.09 | 0.30 | | 0.87 | 8 | 1.04 | 20 | Excellent | Excellent |
| 19 | 3.55 | 0.15 | 0.30 | | 0.8 | 0 | 1.01 | 30 | Excellent | Excellent |
| 20 | 3.55 | 0.25 | 0.30 | | 0.73 | 0 | 1.01 | 30 | Excellent | Excellent |
| 21 | 3.3 | 0.05 | 0.25 | | 0.79 | 2 | 1.01 | 30 | Excellent | Excellent |
| 22 | 3.3 | 0.05 | 0.32 | | 0.83 | 2 | 1.02 | 30 | Excellent | Excellent |
| 23 | 3.3 | 0.05 | 0.38 | | 0.86 | 10 | 1.04 | 20 | Excellent | Excellent |
| 24 | 3.3 | 0.05 | 0.45 | | 0.93 | 35 | 1.10 | 20 | Excellent | Poor |

Next, we studied such oxygen partial pressure with which the Cr-depleted layer ratio is in the range according to the present disclosure, in a state in which the variation of the density depending on the manufacturing conditions is reduced.

<Experiment 5>

A steel slab having a composition containing, in mass %, C: 0.02%, Si: 3.0%, Mn: 0.050%, P: 0.07%, S: 0.002%, Al: 0.007%, Se: 0.001%, N: 0.0050%, and Cr: 0.06% with the balance being Fe and inevitable impurities was heated at 1200° C., then hot rolled to form a hot-rolled sheet with a sheet thickness of 2.6 mm, and then subjected to hot band annealing at 1050° C. for 80 sec. The steel sheet was then cold rolled to a sheet thickness of 0.23 mm, and subjected to decarburization annealing in an oxidizing atmosphere: $PH_2O/PH_2$=0.40 at 850° C. for 2 min. After this, MgO in slurry form was applied to the steel sheet surface as an annealing separator. The steel sheet was then subjected to final annealing intended for secondary recrystallization and purification, at 1180° C. for 75 hr in a $H_2$ atmosphere.

Following this, any unreacted separator was removed, and tension coating baking treatment also serving as flattening annealing was performed. In each of the temperature ranges: (1) 350° C. or less, (2) 450° C. or less, (3) 600° C. or less, and (4) 600° C. to 800° C. as the heating temperature in a heating process in this tension coating baking treatment, i.e. a drying and baking process after applying a coating liquid, sheet passing was performed while controlling the partial pressure of each component gas in a DX gas atmosphere ($CO_2$, CO, $H_2$, $H_2O$, and the balance being $N_2$) to change the oxygen partial pressure in a range of 0.005 to 0.45. As the sheet passing pattern, the pattern I including a part that imparts bending in the direction opposite to the coil set after the final annealing illustrated in FIG. 5 was used. The tension in the sheet passing was 1.2 kgf/mm$^2$ (11.8 MPa).

The product sheet produced in the above-described manner was then used to produce a wound core, and the wound core was subjected to stress relief annealing in a DX gas atmosphere ($CO_2$: 15%, CO: 3%, $H_2$: 0.5%, and the balance being $N_2$, dew point: 30° C.) at 860° C. for 5 hr. The ratio between the wound core iron loss $W_{17/50}$ (1.7 T, 50 Hz) and the product sheet iron loss $W_{17/50}$, the Cr concentration ratio of the Cr-depleted layer to the steel substrate, the carburizing quantity, the nitriding quantity, the resistance to coating exfoliation, and the sheet passing property were evaluated. The results are shown in Table 5. The resistance to coating exfoliation, the iron loss ratio, the product sheet property, and the sheet passing property were evaluated in the same way as in Experiment 1.

In a temperature range of 300° C. to 600° C. that was able to be recognized in the foregoing Experiment 1, favorable properties were exhibited when the oxygen partial pressure was 0.01 atm to 0.25 atm. On the other hand, when the oxygen partial pressure was less than 0.01 atm, the oxygen transfer path was secured, but the formation of the Cr-based oxide film was insufficient due to insufficient oxygen content. When the oxygen partial pressure was more than 0.25 atm, a sufficient oxygen transfer path was secured and also the oxygen content was high, which resulted in excessive Cr-based oxide film formation and led to degradation in product property.

TABLE 5

| Sample No | Treatment temperature range | Oxygen partial pressure in oxide film formation treatment (atm) | Cr concentration ratio of Cr-depleted layer to steel substrate | Nitriding quantity (ppm) | Carburizing quantity (ppm) | Iron loss ratio (wound core iron loss/ product sheet iron loss) | Resistance to coating exfoliation (mmϕ) | Sheet passing property | Product sheet property |
|---|---|---|---|---|---|---|---|---|---|
| 1 | 350° C. | 0.005 | 1 | 40 | 65 | 1.25 | 20 | Excellent | Poor |
| 2 | or less | 0.01 | 0.88 | 5 | 10 | 1.05 | 20 | Excellent | Excellent |
| 3 | | 0.05 | 0.82 | 5 | 9 | 1.05 | 20 | Excellent | Excellent |
| 4 | | 0.1 | 0.78 | 2 | 5 | 1.04 | 20 | Excellent | Excellent |
| 5 | | 0.25 | 0.72 | 0 | 3 | 1.05 | 20 | Excellent | Excellent |
| 6 | | 0.35 | 0.68 | 0 | 2 | 1.04 | 50 | Excellent | Poor |
| 7 | | 0.45 | 0.6 | 0 | 2 | 1.01 | 60 | Excellent | Poor |
| 8 | More than | 0.005 | 0.93 | 38 | 63 | 1.24 | 20 | Excellent | Poor |
| 9 | 350° C. and | 0.01 | 0.87 | 6 | 12 | 1.05 | 20 | Excellent | Excellent |
| 10 | 450° C. | 0.05 | 0.8 | 0 | 5 | 1.05 | 20 | Excellent | Excellent |
| 11 | or less | 0.1 | 0.76 | 0 | 5 | 1.05 | 20 | Excellent | Excellent |
| 12 | | 0.25 | 0.73 | 0 | 5 | 1.03 | 30 | Excellent | Excellent |
| 13 | | 0.35 | 0.65 | 0 | 5 | 1.03 | 50 | Excellent | Poor |
| 14 | | 0.45 | 0.5 | 0 | 5 | 1.03 | 60 | Excellent | Poor |
| 15 | More than | 0.005 | 0.91 | 40 | 60 | 1.24 | 20 | Excellent | Poor |
| 16 | 450° C. | 0.01 | 0.85 | 5 | 10 | 1.05 | 20 | Excellent | Excellent |
| 17 | and 600° C. | 0.05 | 0.76 | 0 | 3 | 1.04 | 20 | Excellent | Excellent |
| 18 | or less | 0.1 | 0.72 | 0 | 2 | 1.03 | 30 | Excellent | Excellent |
| 19 | | 0.25 | 0.7 | 0 | 2 | 1.03 | 30 | Excellent | Excellent |
| 20 | | 0.35 | 0.6 | 0 | 2 | 1.03 | 55 | Excellent | Poor |
| 21 | | 0.45 | 0.4 | 0 | 2 | 1.03 | 65 | Excellent | Poor |
| 22 | More than | 0.005 | 1.00 | 38 | 60 | 1.24 | 20 | Excellent | Poor |
| 23 | 600° C. | 0.01 | 1.00 | 42 | 65 | 1.24 | 20 | Excellent | Poor |
| 24 | and 800° C. | 0.05 | 1.00 | 40 | 62 | 1.24 | 20 | Excellent | Poor |
| 25 | or less | 0.1 | 1.00 | 40 | 60 | 1.24 | 20 | Excellent | Poor |
| 26 | | 0.25 | 1.00 | 38 | 58 | 1.24 | 20 | Excellent | Poor |
| 27 | | 0.35 | 1.00 | 40 | 60 | 1.24 | 20 | Excellent | Poor |
| 28 | | 0.45 | 1.00 | 40 | 62 | 1.24 | 20 | Excellent | Poor |

Next, we studied the bending conditions in the sheet passing to reduce the variation of the density of the forsterite film.

<Experiment 6>

This experiment was based on the conditions 17 in the foregoing Experiment 4 with which, when sheet passing is performed in the pattern II illustrated in FIG. 5, the Cr-depleted layer ratio is approximately 1 and oxygen supply is likely to be hindered most. A steel slab having a composition containing, in mass %, C: 0.075%, Si: 3.55%, Mn: 0.020%, P: 0.01%, S: 0.004%, Al: 0.026%, Se: 0.022%, N: 0.0075%, and Cr: 0.01% with the balance being Fe and inevitable impurities was heated at 1450° C., then hot rolled to form a hot-rolled sheet with a sheet thickness of 2.6 mm, and then subjected to hot band annealing at 1100° C. for 80 sec. The steel sheet was then cold rolled to a sheet thickness of 0.25 mm, and subjected to decarburization annealing in an oxidizing atmosphere: $PH_2O/PH_2$=0.30 at 850° C. for 2 min. Subsequently, a sample with a width of 100 mm and a length of 300 mm was cut out of the decarburization annealed sheet in coil form. Using the sample, the subsequent processes were performed offline. MgO in slurry form was applied to the sample. The sample was placed in a flat state, and subjected to final annealing intended for secondary recrystallization and purification at 1200° C. for 15 hr in a $H_2$ atmosphere.

Subsequently, after removing any unreacted separator, the sample was wound once around each roller different in size shown in Table 6, and then subjected to tension coating baking treatment also serving as flattening annealing. In a temperature range of 400° C. to 550° C. as the heating temperature in a heating process in this tension coating baking treatment, i.e. a drying and baking process after applying a coating liquid, sheet passing was performed in a DX gas atmosphere ($CO_2$, CO, $H_2$, $H_2O$, and the balance being $N_2$) with an oxygen partial pressure of 0.1 atm. The winding and the tension coating baking treatment were performed in a tensionless state. After this, Epstein test pieces were produced from the sample, and subjected to stress relief annealing in a $N_2$ atmosphere at 850° C. for 10 hr. The Cr concentration ratio of the Cr-depleted layer to the steel substrate, the nitriding quantity, and the iron loss ratio between before and after the stress relief annealing were evaluated.

TABLE 6

| Sample No. | Si content (mass %) | Cr content (mass %) | Oxidizability of atmosphere in decarburization annealing | Roller diameter | Cr concentration ratio of Cr-depleted layer to steel substrate | Nitriding quantity (ppm) | Iron loss ratio between before and after stress relief annealing |
|---|---|---|---|---|---|---|---|
| 1 | 3.55 | 0.01 | 0.30 | None | 0.98 | 55 | 1.12 |
| 2 | | | | 2200 | 0.90 | 15 | 1.06 |
| 3 | | | | 2000 | 0.90 | 15 | 1.06 |
| 4 | | | | 1750 | 0.89 | 11 | 1.05 |
| 5 | | | | 1600 | 0.89 | 11 | 1.05 |
| 6 | | | | 1500 | 0.83 | 2 | 1.02 |
| 7 | | | | 1000 | 0.78 | 1 | 1.02 |
| 8 | | | | 750 | 0.75 | 0 | 1.01 |
| 9 | | | | 500 | 0.75 | 0 | 1.01 |
| 10 | | | | 250 | 0.75 | 0 | 1.01 |

The evaluation results are shown in Table 6. As can be understood from Table 6, by imparting each of various bends corresponding to bending opposite to the coil set, the Cr concentration ratio of the Cr-depleted layer to the steel substrate was limited to the range according to the present disclosure, and the iron loss degradation due to the stress relief annealing was reduced. Here, since the curvature radius in the steel sheet wounded in a coil changes continuously, even when the steel sheet wounded in a coil is wound using the same roller in the direction opposite to the coil set, the applied stress is not uniform in the coil (the applied stress is smaller when the coil diameter is larger). The ultimate condition with which the applied stress is smallest is bending from a flat state. Hence, if the variation of the density is reduced by bending even in the case where the film is formed in a flat state as in this experiment, this means that the variation of the density can be reduced in all conditions. In particular, it is very effective to impart bending using a roller with a diameter of Φ1500 mm or less. Although it is also possible to achieve the presently disclosed technology by adjusting the manufacturing conditions based on the variation, this takes time, and adjustment by imparting bending is easier. It is more preferable to use a roller of Φ1500 mm or less in the sheet passing.

These results demonstrate that it is important to impart bending in the direction opposite to the coil set. Preferably, bending with a curvature radius of 750 mm or less is imparted. The imparting of bending is not limited to the pattern I in FIG. 5, and may be in any of various forms such as performing predetermined bending a plurality of times through many rollers.

The present disclosure is based on these new discoveries. We thus provide:

1. A grain-oriented electrical steel sheet comprising:

a steel substrate;

a forsterite film on a surface of the steel substrate; and a Cr-depleted layer at a boundary between the steel substrate and the forsterite film, the Cr-depleted layer having a Cr concentration that is 0.70 times to 0.90 times a Cr concentration of the steel substrate.

2. The grain-oriented electrical steel sheet according to 1., wherein the steel substrate contains Cr: 0.02 mass % or more and 0.20 mass % or less.

3. A method for manufacturing a grain-oriented electrical steel sheet, the method comprising:

subjecting a grain-oriented electrical steel slab to hot rolling, to obtain a hot-rolled steel sheet;

subjecting the hot-rolled steel sheet to cold rolling either once, or twice or more with intermediate annealing performed therebetween, to obtain a cold-rolled steel sheet having a final sheet thickness;

subjecting the cold-rolled steel sheet to decarburization annealing to obtain a decarburization-annealed steel sheet;

applying an annealing separator composed mainly of MgO to the decarburization-annealed steel sheet;

thereafter subjecting the decarburization-annealed steel sheet in coil form to final annealing to obtain a final-annealed steel sheet comprising a steel substrate and a forsterite film on a surface of the steel substrate; and thereafter forming a tension coating on the final-annealed steel sheet, wherein oxidizability of atmosphere in at least a temperature range of 300° C. to 600° C. in a sheet passing process from after the final annealing to when baking the tension coating is controlled to form, at a boundary between the steel substrate and the forsterite film, a Cr-depleted layer having a Cr concentration that is 0.70 times to 0.90 times a Cr concentration of the steel substrate.

4. The method for manufacturing a grain-oriented electrical steel sheet according to 3., wherein after the final annealing and before forming the Cr-depleted layer, the final-annealed steel sheet is passed through a pass line including at least one part that imparts bending in a direction opposite to coil set remaining in the final-annealed steel sheet, and the oxidizability of atmosphere when forming the Cr-depleted layer is controlled to an oxygen partial pressure $P_{O2}$ of 0.01 atm to 0.25 atm.

5. The method for manufacturing a grain-oriented electrical steel sheet according to 4., wherein a curvature radius of the bending is 750 mm or less.

6. The method for manufacturing a grain-oriented electrical steel sheet according to any one of 3. to 5., wherein the grain-oriented electrical steel slab contains Cr: 0.02 mass % or more and 0.20 mass % or less.

Advantageous Effect

It is thus possible to obtain a grain-oriented electrical steel sheet having better transformer iron loss property than conventional grain-oriented electrical steel sheets. That is, the building factor can be further reduced.

DETAILED DESCRIPTION

Figure 1:
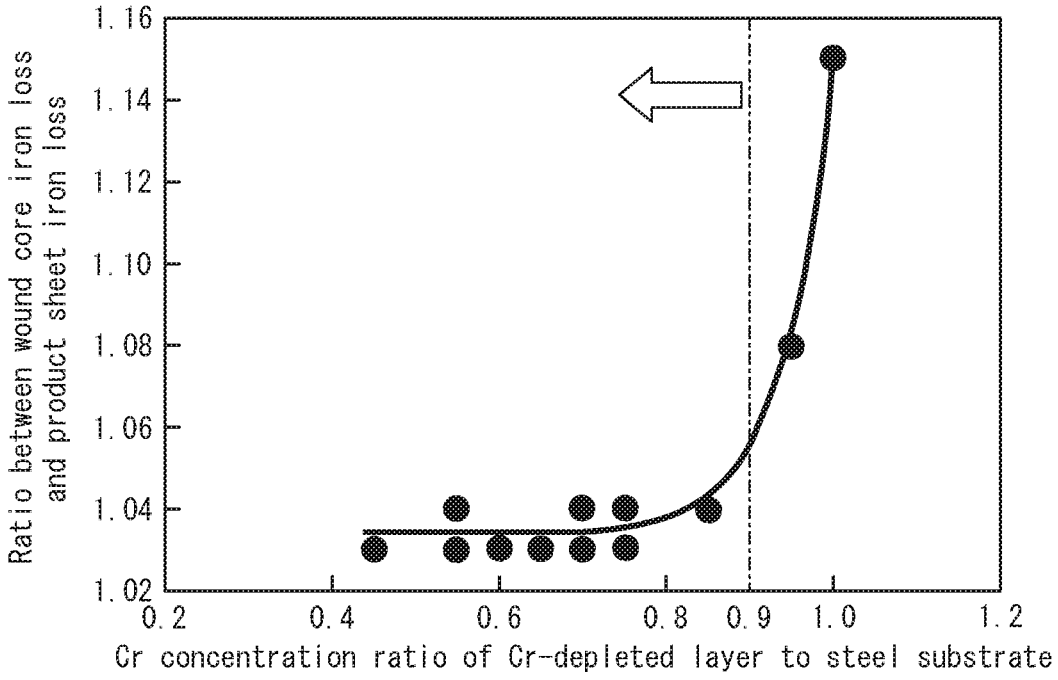
FIG. 1 is a graph illustrating the relationship between the Cr concentration ratio of the Cr-depleted layer of the steel substrate surface layer to the steel substrate and the iron loss ratio.
Figure 2:
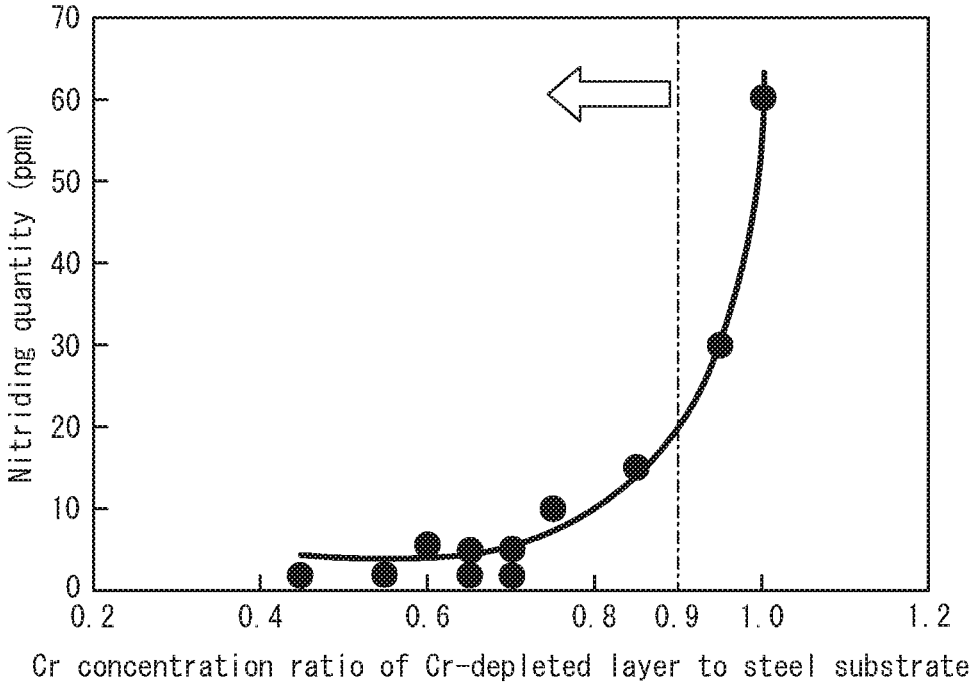
FIG. 2 is a graph illustrating the relationship between the Cr concentration ratio of the Cr-depleted layer of the steel substrate surface layer to the steel substrate and the nitriding quantity.
Figure 3:
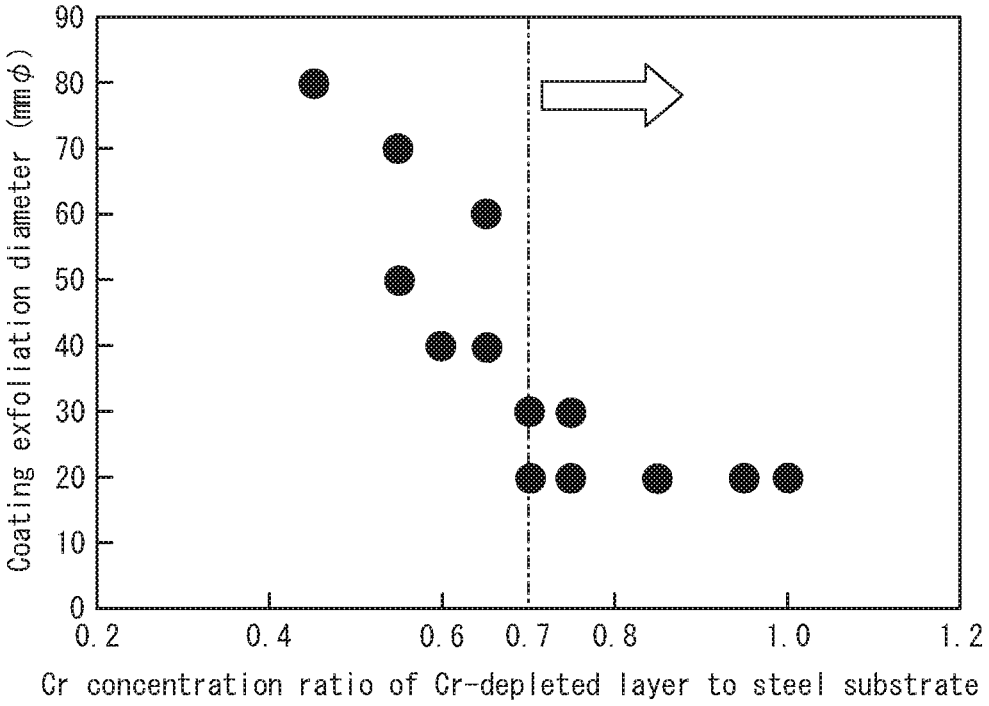
FIG. 3 is a graph illustrating the relationship between the Cr concentration ratio of the Cr-depleted layer of the steel substrate surface layer to the steel substrate and the resistance to coating exfoliation.
Figure 4:
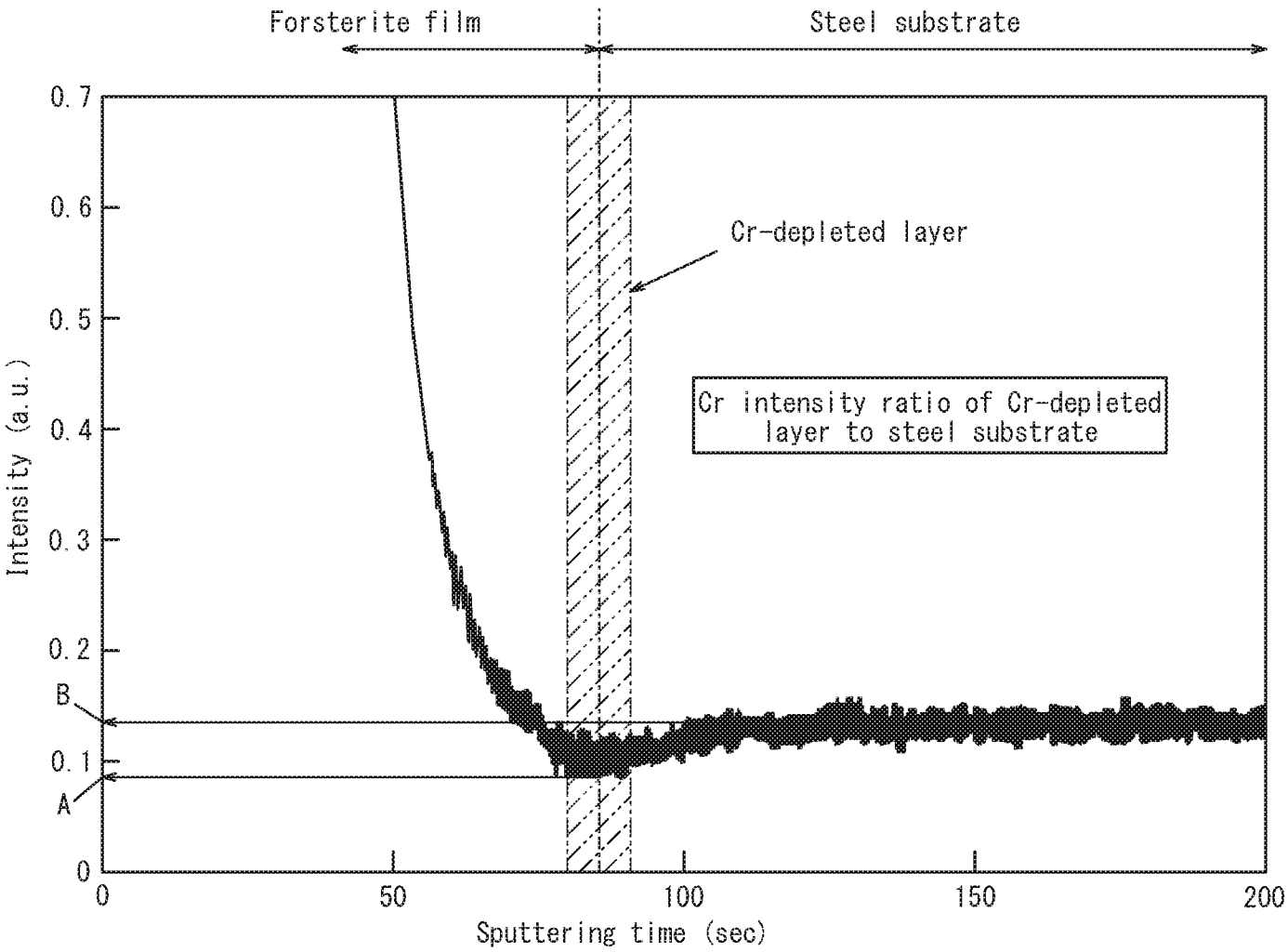
FIG. 4 is a graph illustrating an example of a Cr intensity profile.

A method for manufacturing a grain-oriented electrical steel sheet will be described in detail below.

[Chemical Composition]

The chemical composition of a slab for a grain-oriented electrical steel sheet according to the present disclosure is a chemical composition capable of secondary recrystallization. In the case of using an inhibitor, for example, Al and N are added in appropriate amounts when using a AlN-based inhibitor, and Mn and Se and/or S are added in appropriate amounts when using a MnS/MnSe-based inhibitor. Both inhibitors may be used together. Preferable contents of Al, N, Mn, S, and Se in this case are Al: 0.010 mass % to 0.065 mass %, N: 0.0050 mass % to 0.0120 mass %, S: 0.005 mass % to 0.030 mass %, and Se: 0.005 mass % to 0.030 mass %.

An inhibitorless grain-oriented electrical steel sheet in which the contents of Al, N, S, and Se are limited may be used in the present disclosure. In such a case, the contents of Al, N, S, and Se are preferably limited to Al: 100 mass ppm or less, N: 50 mass ppm or less, S: 50 mass ppm or less, and Se: 50 mass ppm or less.

The basic components and optionally added components of a slab for a grain-oriented electrical steel sheet according to the present disclosure will be described in detail below.

C: 0.08 Mass % or Less

C is added to improve the hot-rolled sheet microstructure. If the C content is more than 0.08 mass %, it is difficult to reduce C to 50 mass ppm or less at which magnetic aging does not occur during the manufacturing process. The C content is therefore preferably 0.08 mass % or less. The lower limit is not particularly limited, as a material not containing C can still be secondary recrystallized. That is, the C content may be 0%.

Si: 2.0 Mass % to 8.0 Mass %

Si is an element effective in enhancing the electrical resistance of the steel and improving the iron loss. If the Si content is less than 2.0 mass %, the iron loss reduction effect is insufficient. If the Si content is more than 8.0 mass %, the workability decreases significantly, and the magnetic flux density decreases, too. The Si content is therefore preferably in a range of 2.0 mass % to 8.0 mass %.

Mn: 0.005 Mass % to 1.000 Mass %

Mn is an element necessary for achieving favorable hot workability. If the Mn content is less than 0.005 mass %, the addition of Mn is not effective. If the Mn content is more than 1.000 mass %, the magnetic flux density of the product sheet decreases. The Mn content is therefore preferably in a range of 0.005 mass % to 1.000 mass %.

Cr: 0.02 Mass % to 0.20 Mass %

Cr is an element that facilitates the formation of a dense oxide film at the interface between the forsterite film and the steel substrate. Although the oxide film formation is possible without Cr, the expansion of the suitable range and the like can be expected by adding Cr. If the Cr content is more than 0.20%, the oxide film is excessively thick, which decreases the resistance to coating exfoliation. The Cr content is therefore preferably in the foregoing range.

In addition to the basic components described above, the following elements may be contained as appropriate.

At least one selected from the group consisting of Ni: 0.03 mass % to 1.50 mass %, Sn: 0.010 mass % to 1.500 mass %, Sb: 0.005 mass % to 1.500 mass %, Cu: 0.02 mass % to 0.20 mass %, P: 0.03 mass % to 0.50 mass %, and Mo: 0.005 mass % to 0.100 mass %

Ni is useful for improving the hot-rolled sheet microstructure and improving the magnetic property. If the Ni content is less than 0.03 mass %, the magnetic property improving effect is low. If the Ni content is more than 1.50 mass %, secondary recrystallization is unstable, and the magnetic property degrades. The Ni content is therefore preferably in a range of 0.03 mass % to 1.50 mass %.

Sn, Sb, Cu, P, and Mo are each an element useful for improving the magnetic property. If the content of each of these components is less than the corresponding lower limit, the magnetic property improving effect is low. If the content of each of these components is more than the corresponding upper limit, the development of secondary recrystallized grains is inhibited. The content of each of these components is therefore preferably in the foregoing range.

The balance other than the components described above is Fe and inevitable impurities mixed in the manufacturing process.

A method for manufacturing a grain-oriented electrical steel sheet according to the present disclosure will be described below.

[Heating]

A slab having the chemical composition described above is heated according to a conventional method. The heating temperature is preferably 1150° C. to 1450° C.

[Hot Rolling]

After the heating, the slab is hot rolled. Alternatively, the slab may be directly hot rolled without heating, after casting. In the case of a thin slab or thinner cast steel, it may or may not be hot rolled.

In the case of hot rolling the slab, it is preferable to set the rolling temperature in the rough rolling final pass to 900° C. or more and the rolling temperature in the finish rolling final pass to 700° C. or more.

[Hot Band Annealing]

After this, the hot-rolled sheet is optionally hot band annealed. For high development of Goss texture in the product sheet, the hot band annealing temperature is preferably in a range of 800° C. to 1100° C. If the hot band annealing temperature is less than 800° C., band texture in the hot rolling remains, making it difficult to realize homogenized primary recrystallized microstructure and inhibiting the development of secondary recrystallized grains. If the hot band annealing temperature is more than 1100° C., the grain size after the hot band annealing is excessively coarse, making it difficult to realize homogenized primary recrystallized microstructure.

[Cold Rolling]

Following this, the hot-rolled sheet is cold rolled either once, or twice or more with intermediate annealing performed therebetween. The intermediate annealing temperature is preferably 800° C. or more and 1150° C. or less. The intermediate annealing time is preferably about 10 sec to 100 sec.

[Decarburization Annealing]

The cold-rolled sheet is then subjected to decarburization annealing to obtain a decarburization-annealed sheet. The decarburization annealing is preferably performed with an annealing temperature of 750° C. to 900° C., an oxidizing atmosphere $PH_2O/PH_2$ of 0.25 to 0.60, and an annealing time of about 50 sec to 300 sec.

[Application of Annealing Separator]

After this, an annealing separator is applied to the decarburization-annealed sheet. The annealing separator is preferably composed mainly of MgO, and applied in an amount of about 8 g/m$^2$ to 15 g/m$^2$.

[Final Annealing]

The decarburization-annealed sheet is then subjected to final annealing intended for secondary recrystallization and forsterite film formation. Preferably, the annealing temperature is 1100° C. or more, and the annealing time is 30 min or more. It is further preferable to, after the final annealing, pass the steel sheet through a pass line including at least one part that imparts bending in the direction opposite to coil set (residual curvature) remaining in the steel sheet.

[Additional Oxidizing Treatment]

Subsequently, continuous annealing for additional oxidizing treatment is performed after removing any unreacted separator and before applying an insulating coating. Alternatively, baking treatment also serving as additional oxidizing treatment is performed after applying an insulating coating. As a result of either one of these processes, an additional oxide film is formed at the interface between the forsterite film and the steel substrate.

Specifically, in the additional oxidizing treatment, by controlling the oxidizability of atmosphere in at least one part of the process of performing the continuous annealing or the insulating coating baking treatment in a temperature range of 300° C. to 600° C., a Cr-depleted layer having a Cr concentration that is 0.70 times to 0.90 times the Cr concentration of the steel substrate is formed at the boundary between the steel substrate and the forsterite film. The oxidizability of atmosphere when forming the Cr-depleted layer is further preferably controlled to an oxygen partial pressure $P_{O2}$ of 0.01 atm to 0.25 atm.

[Flattening Treatment and Insulating Coating]

In the foregoing insulating coating application and baking treatment, flattening treatment may be simultaneously performed for shape adjustment. The flattening annealing is preferably performed with an annealing temperature of 750° C. to 950° C. and an annealing time of about 10 sec to 200 sec.

In the present disclosure, an insulating coating is formed on the steel sheet surface before or after the flattening annealing. This insulating coating is such a coating (tension coating) that imparts tension to the steel sheet for iron loss reduction. Examples of the tension coating include an inorganic coating containing silica and a ceramic coating by physical vapor deposition, chemical vapor deposition, or the like.

The resultant steel sheet may be irradiated with a laser, plasma, an electron beam, or the like to undergo magnetic domain refining, for further iron loss reduction. Moreover, an etching resist may be attached to the steel sheet after the final cold rolling by printing or the like, and then the region without the etching resist attached thereto may be subjected to treatment such as electrolytic etching to form linear grooves.

The other manufacturing conditions may comply with typical grain-oriented electrical steel sheet manufacturing methods.

EXAMPLES

Example 1

Steel slabs having a composition containing the components shown in Table 7 with the balance being substantially Fe were each produced by continuous casting, heated to 1420° C., and then hot rolled to obtain a hot-rolled sheet with a sheet thickness of 1.8 mm. The hot-rolled sheet was then subjected to hot band annealing at 1000° C. for 100 sec. Following this, the hot-rolled sheet was cold rolled to an intermediate sheet thickness of 0.45 mm, and subjected to intermediate annealing under the conditions of oxidizability: $PH_2O/PH_2$=0.40, temperature: 1000° C., and time: 70 sec. Subsequently, after removing subscale from the surface by pickling with hydrochloric acid, the steel sheet was cold rolled again to obtain a cold-rolled sheet with a sheet thickness of 0.23 mm.

The cold-rolled sheet was then subjected to decarburization annealing in which the cold-rolled sheet was held at a soaking temperature of 830° C. for 300 sec. After this, an annealing separator composed mainly of MgO was applied, and final annealing intended for secondary recrystallization, forsterite film formation, and purification was performed at 1200° C. for 30 hr. After removing any unreacted separator, the cold-rolled sheet was subjected to continuous annealing for forming a dense oxide film at the interface between the forsterite film and the steel substrate. The end-point temperature, the atmosphere, and the line tension in the continuous annealing are shown in Table 8. Lastly, an insulation coating containing 60% of colloidal silica and aluminum phosphate was applied, and baked at 800° C. This coating application process also serves as flattening annealing. The resultant product was then used to produce a wound core, and the wound core was subjected to stress relief annealing in a $N_2$ atmosphere at 860° C. for 10 hr.

TABLE 7

| Steel | Chemical composition (mass %) | | | | | | | | | | | | | |
|---|---|---|---|---|---|---|---|---|---|---|---|---|---|---|
| No. | C | Si | Mn | Ni | Cr | P | Mo | Sb | Sn | Al | N | Se | S | O |
| A | 0.08 | 3.4 | 0.030 | 0.01 | 0.08 | 0.03 | 0.030 | 0.030 | 0.001 | 0.030 | 0.0100 | 0.001 | 0.002 | 0.0015 |

The results of performing the same measurements as in the foregoing Experiment 1 are shown in Table 8. As can be seen from Nos. 1 to 12 in Table 8, even in the case where the products were made using the same product sheets and the same manufacturing conditions, if the treatment conditions of the dense oxide film formation at the interface between the forsterite film and the steel substrate changed, the Cr concentration ratio of the Cr-depleted layer to the steel substrate (oxide film formation state) changed. In the case where the oxide film formation amount was excessively low (the Cr concentration ratio of the Cr-depleted layer to the steel substrate was excessively high), nitriding in the stress relief annealing was not suppressed. In the case where the oxide film formation amount was excessively high (the Cr concentration ratio of the Cr-depleted layer to the steel substrate was excessively low), an increase in the film thickness of the oxide film led to lower adhesion of the steel substrate, thus causing a decrease in the resistance to coating exfoliation. These results demonstrate that it is important to control the two parameters, i.e. the oxide film formation temperature and the treatment atmosphere (oxygen partial pressure), in combination.

Figure 5:
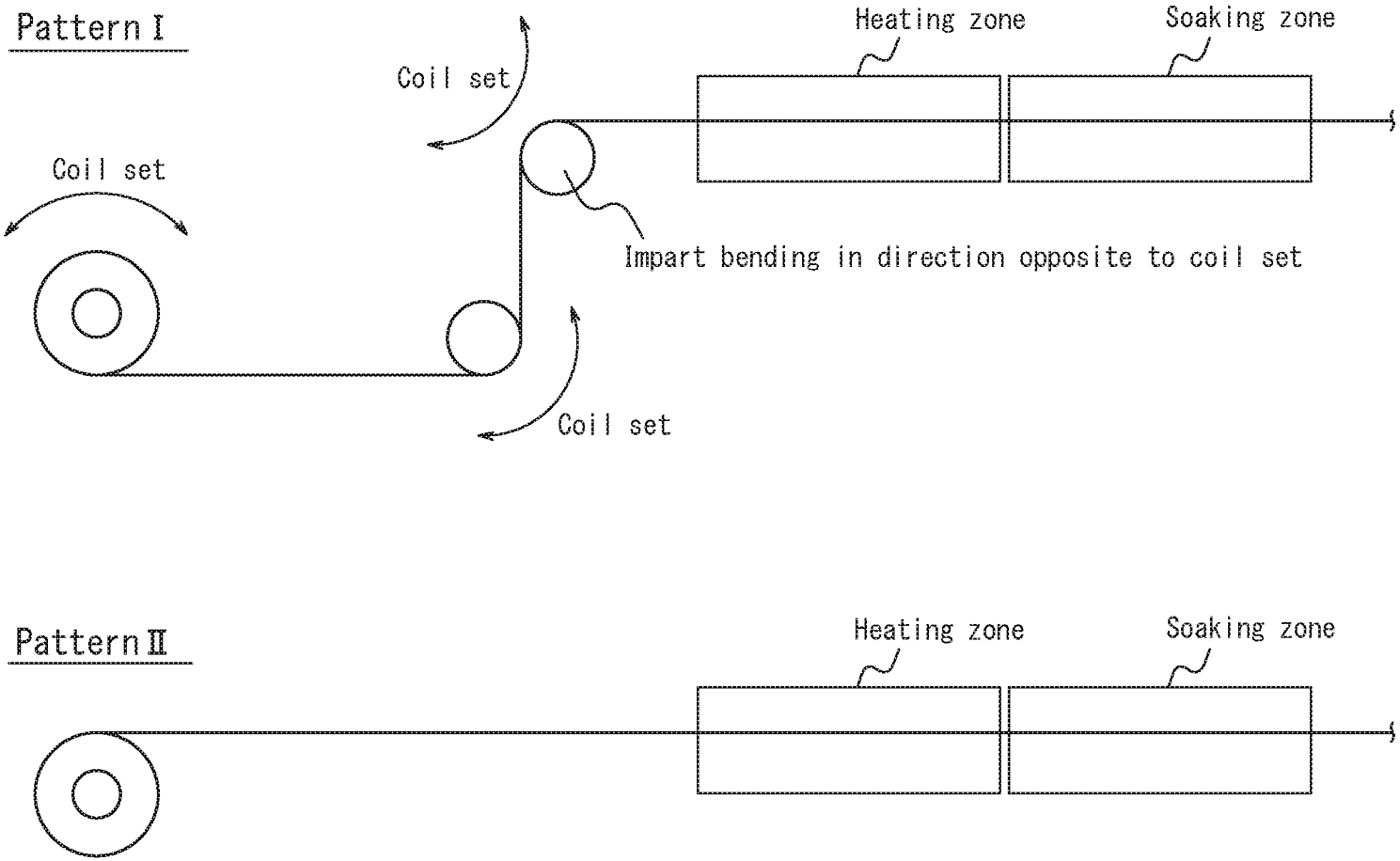
FIG. 5 is a schematic diagram illustrating sheet passing patterns after final annealing.

Nos. 13 to 24 correspond to results when passing the steel sheet through a pass line (pattern I in FIG. 5) including at least one part that imparts, by a roller of Φ1000 mm, bending in the direction opposite to coil set (residual curvature) which occurs in the steel sheet when annealed in coil form. In Nos. 1 to 12, the two parameters, i.e. the oxide film formation temperature and the treatment oxygen partial pressure, need to be controlled in combination in the range according to the present disclosure. In Nos. 13 to 24, even when the end-point temperature was different, the appropriate oxygen partial pressure was the same (comparison of Nos. 16, 17, 18, 19, 20, and 21), and favorable results were obtained by controlling only the oxygen partial pressure.

Nos. 25 to 30 correspond to evaluation results of products with different manufacturing conditions. Even in the case where the oxide film formation conditions were the same, if other manufacturing conditions were different, the Cr depletion proportion varied. This indicates the need to control a combination of a plurality of parameters, i.e. normal conditions such as the oxidizing atmosphere in the decarburization annealing and the amount of MgO applied and the oxygen partial pressure in the oxide film formation. Nos. 31 to 36 correspond to results when passing the steel sheet through a pass line including at least one part that imparts, by a roller of Φ500 mm, bending in the direction opposite to coil set (residual curvature) which occurs in the steel sheet when annealed in coil form. No dependence on the other manufacturing conditions was recognized here, and favorable properties were obtained if the oxide film formation conditions satisfied the conditions according to the present disclosure.

TABLE 8

| Sample No. | Steel No. | Oxidizability in decarburization annealing $PH_2O/PH_2$ | Amount of MgO applied ($g/m^2$) | Oxide film formation treatment line tension ($kgf/mm^2$) | Number of parts that impart bending in direction opposite to coil set which occurs when annealed in coil form | End-point temperature in continuous annealing (° C.) | Oxygen partial pressure in oxide film formation treatment (atm) | Cr concentration ratio of Cr-depleted layer to steel substrate | Nitriding quantity (ppm) | Iron loss ratio (wound core iron loss/product sheet iron loss) | Resistance to coating exfoliation (mmϕ) | Remarks |
|---|---|---|---|---|---|---|---|---|---|---|---|---|
| 1 | A | 0.45 | 12.0 | 1.1 | 0 | 200 | 0.05 | 1.00 | 70 | 1.18 | 20 | Comp. Ex. |
| 2 | A | 0.45 | 12.0 | 1.1 | 0 | | 0.1 | 1.00 | 70 | 1.18 | 20 | Comp. Ex. |
| 3 | A | 0.45 | 12.0 | 1.1 | 0 | | 0.3 | 1.00 | 70 | 1.18 | 20 | Comp. Ex. |
| 4 | A | 0.45 | 12.0 | 1.1 | 0 | 420 | 0.05 | 0.92 | 9 | 1.04 | 20 | Comp. Ex. |
| 5 | A | 0.45 | 12.0 | 1.1 | 0 | | 0.1 | 0.85 | 4 | 1.04 | 20 | Ex. |
| 6 | A | 0.45 | 12.0 | 1.1 | 0 | | 0.3 | 0.78 | 4 | 1.04 | 20 | Ex. |
| 7 | A | 0.45 | 12.0 | 1.1 | 0 | 520 | 0.05 | 0.88 | 2 | 1.01 | 20 | Ex. |
| 8 | A | 0.45 | 12.0 | 1.1 | 0 | | 0.1 | 0.78 | 4 | 1.03 | 20 | Ex. |
| 9 | A | 0.45 | 12.0 | 1.1 | 0 | | 0.3 | 0.65 | 2 | 1.01 | 65 | Comp. Ex. |
| 10 | A | 0.45 | 12.0 | 1.1 | 0 | 650 | 0.05 | 1.00 | 67 | 1.16 | 20 | Comp. Ex. |
| 11 | A | 0.45 | 12.0 | 1.1 | 0 | | 0.1 | 1.00 | 66 | 1.17 | 20 | Comp. Ex. |
| 12 | A | 0.45 | 12.0 | 1.1 | 0 | | 0.3 | 1.00 | 68 | 1.16 | 20 | Comp. Ex. |
| 13 | A | 0.45 | 12.0 | 1.1 | 1 | 200 | 0.05 | 1.00 | 70 | 1.18 | 20 | Comp. Ex. |
| 14 | A | 0.45 | 12.0 | 1.1 | 1 | | 0.1 | 1.00 | 70 | 1.18 | 20 | Comp. Ex. |
| 15 | A | 0.45 | 12.0 | 1.1 | 1 | | 0.3 | 1.00 | 70 | 1.18 | 20 | Comp. Ex. |
| 16 | A | 0.45 | 12.0 | 1.1 | 1 | 420 | 0.05 | 0.85 | 9 | 1.04 | 20 | Ex. |
| 17 | A | 0.45 | 12.0 | 1.1 | 1 | | 0.1 | 0.81 | 4 | 1.04 | 20 | Ex. |
| 18 | A | 0.45 | 12.0 | 1.1 | 1 | | 0.3 | 0.68 | 4 | 1.04 | 60 | Comp. Ex. |
| 19 | A | 0.45 | 12.0 | 1.1 | 2 | 520 | 0.05 | 0.88 | 2 | 1.01 | 20 | Ex. |
| 20 | A | 0.45 | 12.0 | 1.1 | 2 | | 0.1 | 0.78 | 4 | 1.03 | 20 | Ex. |
| 21 | A | 0.45 | 12.0 | 1.1 | 2 | | 0.3 | 0.65 | 2 | 1.01 | 65 | Comp. Ex. |
| 22 | A | 0.45 | 12.0 | 1.1 | 1 | 650 | 0.05 | 1.00 | 67 | 1.16 | 20 | Comp. Ex. |
| 23 | A | 0.45 | 12.0 | 1.1 | 1 | | 0.1 | 1.00 | 66 | 1.17 | 20 | Comp. Ex. |
| 24 | A | 0.45 | 12.0 | 1.1 | 1 | | 0.3 | 1.00 | 68 | 1.16 | 65 | Comp. Ex. |
| 25 | A | 0.4 | 5.5 | 1.5 | 0 | 480 | 0.1 | 0.83 | 2 | 1.03 | 20 | Ex. |
| 26 | A | 0.4 | 8.5 | 1.5 | | | | 0.91 | 45 | 1.14 | 20 | Comp. Ex. |
| 27 | A | 0.4 | 13 | 1.5 | | | | 0.95 | 50 | 1.15 | 20 | Comp. Ex. |
| 28 | A | 0.2 | 8.5 | 1.5 | 0 | 480 | 0.1 | 0.78 | 2 | 1.01 | 20 | Ex. |
| 29 | A | 0.3 | 8.5 | 1.5 | | | | 0.85 | 4 | 1.03 | 20 | Ex. |
| 30 | A | 0.5 | 8.5 | 1.5 | | | | 0.93 | 45 | 1.14 | 20 | Comp. Ex. |
| 31 | A | 0.4 | 5.5 | 1.5 | 1 | 480 | 0.1 | 0.81 | 2 | 1.03 | 20 | Ex. |
| 32 | A | 0.4 | 8.5 | 1.5 | | | | 0.81 | 5 | 1.04 | 20 | Ex. |
| 33 | A | 0.4 | 13 | 1.5 | | | | 0.81 | 4 | 1.04 | 20 | Ex. |
| 34 | A | 0.2 | 8.5 | 1.5 | 1 | 480 | 0.1 | 0.78 | 2 | 1.01 | 20 | Ex. |
| 35 | A | 0.3 | 8.5 | 1.5 | | | | 0.78 | 4 | 1.03 | 20 | Ex. |
| 36 | A | 0.5 | 8.5 | 1.5 | | | | 0.78 | 8 | 1.05 | 20 | Ex. |

Example 2

Steel slabs having a composition containing the components shown in Table 9 with the balance being substantially Fe were each produced by continuous casting, heated to 1400° C., and then hot rolled to obtain a hot-rolled sheet with a sheet thickness of 2.6 mm. The hot-rolled sheet was then subjected to hot band annealing at 950° C. for 10 sec. Following this, the hot-rolled sheet was cold rolled to an intermediate sheet thickness of 0.80 mm, and subjected to intermediate annealing under the conditions of oxidizability: $PH_2O/PH_2$=0.35, temperature: 1070° C., and time: 200 sec. Subsequently, after removing subscale from the surface by pickling with hydrochloric acid, the steel sheet was cold rolled again to obtain a cold-rolled sheet with a sheet thickness of 0.20 mm.

The cold-rolled sheet was then subjected to decarburization annealing in which the cold-rolled sheet was held at a soaking temperature of 860° C. for 30 sec. After this, an annealing separator composed mainly of MgO was applied, and final annealing intended for secondary recrystallization, forsterite film formation, and purification was performed at 1150° C. for 10 hr. After removing any unreacted separator, a coating liquid containing 50% of colloidal silica and aluminum phosphate was applied, and tension coating baking treatment (baking temperature: 850° C.) also serving as flattening annealing was performed. In a temperature range in the heating process in this tension coating baking treatment, a DX gas atmosphere ($CO_2$: 15%, CO: 3%, $H_2$: 0.5%, and the balance being $N_2$, dew point: 30° C.) was used, thus performing oxide film formation treatment. The oxide film formation treatment conditions and the other manufacturing conditions are shown in Table 9. Lastly, a coating liquid containing 50% of colloidal silica and aluminum phosphate was applied, and baked at 800° C. This coating application process also serves as flattening annealing. The resultant product sheet was then used to produce a wound core, and the wound core was subjected to stress relief annealing in a DX gas atmosphere ($CO_2$: 15%, CO: 3%, $H_2$: 0.5%, and the balance being $N_2$, dew point: 30° C.) at 860° C. for 10 hr.

TABLE 9

| Sample | Chemical composition (mass %) | | | | | | | | | | | | | |
|---|---|---|---|---|---|---|---|---|---|---|---|---|---|---|
| No. | C | Si | Mn | Ni | Cr | P | Mo | Sb | Sn | Al | N | Se | S | O |
| A | 0.08 | 3.4 | 0.030 | 0.01 | 0.01 | 0.03 | 0.030 | 0.030 | 0.001 | 0.030 | 0.0100 | 0.001 | 0.002 | 0.0015 |
| B | 0.05 | 3.4 | 0.030 | 0.07 | 0.08 | 0.05 | 0.001 | 0.020 | 0.001 | 0.025 | 0.0080 | 0.013 | 0.004 | 0.0010 |
| C | 0.07 | 3 | 0.050 | 0.01 | 0.08 | 0.01 | 0.001 | 0.001 | 0.030 | 0.007 | 0.0040 | 0.001 | 0.001 | 0.0010 |
| D | 0.02 | 2.5 | 0.010 | 0.05 | 0.15 | 0.02 | 0.010 | 0.001 | 0.014 | 0.008 | 0.0038 | 0.008 | 0.001 | 0.0013 |

The results of performing the same measurements as in the foregoing Experiment 1 are shown in Table 10. As can be seen from Nos. 1 to 16 in Table 10, even in the case where the manufacturing conditions were the same, the proportion of the Cr-depleted layer varied if the steel composition was different. Thus, there is no specific suitable range in controlling the proportion of the Cr-depleted layer to be in the range according to the present disclosure, but the proportion needs to be adjusted according to the manufacturing conditions (the combination of influential factors) each time. Even with different conditions, favorable product property was achieved if the proportion of the Cr-depleted layer was limited to the range according to the present disclosure.

Nos. 16 to 32 correspond to results when passing the steel sheet through a pass line including at least one part that imparts bending in the direction opposite to coil set (residual curvature) which occurs in the steel sheet when annealed in coil form. In the case where the oxygen partial pressure was in a range of 0.01 atm to 0.25 atm, the proportion of the Cr-depleted layer was suitable regardless of the steel composition (Nos. 21 to 28), and favorable product property was achieved.

TABLE 10

| Sample No. | Steel No. | Oxidizability in decarburization annealing $PH_2O/PH_2$ | Amount of MgO applied ($g/m^2$) | Oxide film formation treatment line tension ($kgf/mm^2$) | Number of parts that impart bending in direction opposite to coil set which occurs when annealed in coil form | Oxide film formation treatment temperature range | Oxide film formation treatment atmosphere oxygen partial pressure (atm) |
|---|---|---|---|---|---|---|---|
| 1 | A | 0.4 | 10.0 | 1.5 | 0 | 100 to | 0.005 |
| 2 | B | 0.4 | 10.0 | 1.5 | 0 | 420° C. | |
| 3 | C | 0.4 | 10.0 | 1.5 | 0 | | |
| 4 | D | 0.4 | 10.0 | 1.5 | 0 | | |
| 5 | A | 0.4 | 10.0 | 1.5 | 0 | 100 to | 0.05 |

TABLE 10-continued

| | | | | | | | |
|---|---|---|---|---|---|---|---|
| 6 | B | 0.4 | 10.0 | 1.5 | 0 | 420° C. | |
| 7 | C | 0.4 | 10.0 | 1.5 | 0 | | |
| 8 | D | 0.4 | 10.0 | 1.5 | 0 | | |
| 9 | A | 0.4 | 10.0 | 1.5 | 0 | 100 to | 0.1 |
| 10 | B | 0.4 | 10.0 | 1.5 | 0 | 420° C. | |
| 11 | C | 0.4 | 10.0 | 1.5 | 0 | | |
| 12 | D | 0.4 | 10.0 | 1.5 | 0 | | |
| 13 | A | 0.4 | 10.0 | 1.5 | 0 | 100 to | 0.3 |
| 14 | B | 0.4 | 10.0 | 1.5 | 0 | 420° C. | |
| 15 | C | 0.4 | 10.0 | 1.5 | 0 | | |
| 16 | D | 0.4 | 10.0 | 1.5 | 0 | | |
| 17 | A | 0.4 | 10.0 | 1.5 | 1 | 100 to | 0.005 |
| 18 | B | 0.4 | 10.0 | 1.5 | 1 | 420° C. | |
| 19 | C | 0.4 | 10.0 | 1.5 | 1 | | |
| 20 | D | 0.4 | 10.0 | 1.5 | 1 | | |
| 21 | A | 0.4 | 10.0 | 1.5 | 3 | 100 to | 0.05 |
| 22 | B | 0.4 | 10.0 | 1.5 | 3 | 420° C. | |
| 23 | C | 0.4 | 10.0 | 1.5 | 3 | | |
| 24 | D | 0.4 | 10.0 | 1.5 | 3 | | |
| 25 | A | 0.4 | 10.0 | 1.5 | 2 | 100 to | 0.1 |
| 26 | B | 0.4 | 10.0 | 1.5 | 2 | 420° C. | |
| 27 | C | 0.4 | 10.0 | 1.5 | 2 | | |
| 28 | D | 0.4 | 10.0 | 1.5 | 2 | | |
| 29 | A | 0.4 | 10.0 | 1.5 | 4 | 100 to | 0.3 |
| 30 | B | 0.4 | 10.0 | 1.5 | 4 | 420° C. | |
| 31 | C | 0.4 | 10.0 | 1.5 | 4 | | |
| 32 | D | 0.4 | 10.0 | 1.5 | 4 | | |

| Sample No. | Cr concentration ratio of Cr-depleted layer to steel substrate | Nitriding quantity (ppm) | Carburizing quantity (ppm) | Iron loss ratio (wound core iron loss/product sheet iron loss) | Resistance to coating exfoliation (mmφ) | Remarks |
|---|---|---|---|---|---|---|
| 1 | 1.00 | 35 | 70 | 1.28 | 20 | Comp. Ex. |
| 2 | 0.95 | 25 | 45 | 1.24 | 20 | Comp. Ex. |
| 3 | 0.92 | 25 | 45 | 1.24 | 20 | Comp. Ex. |
| 4 | 0.88 | 2 | 10 | 1.02 | 20 | Ex. |
| 5 | 0.95 | 30 | 50 | 1.25 | 20 | Comp. Ex. |
| 6 | 0.92 | 15 | 35 | 1.19 | 20 | Comp. Ex. |
| 7 | 0.88 | 0 | 5 | 1.02 | 20 | Ex. |
| 8 | 0.85 | 0 | 5 | 1.02 | 20 | Ex. |
| 9 | 0.92 | 20 | 45 | 1.24 | 20 | Ex. |
| 10 | 0.88 | 3 | 9 | 1.05 | 20 | Ex. |
| 11 | 0.85 | 0 | 3 | 1.02 | 20 | Ex. |
| 12 | 0.83 | 0 | 3 | 1.02 | 20 | Ex. |
| 13 | 0.8 | 0 | 8 | 1.03 | 20 | Ex. |
| 14 | 0.72 | 0 | 2 | 1.02 | 20 | Ex. |
| 15 | 0.65 | 0 | 2 | 1.02 | 50 | Comp. Ex. |
| 16 | 0.55 | 0 | 2 | 1.02 | 60 | Comp. Ex. |
| 17 | 1.00 | 35 | 70 | 1.28 | 20 | Comp. Ex. |
| 18 | 0.95 | 25 | 45 | 1.24 | 20 | Comp. Ex. |
| 19 | 0.92 | 25 | 45 | 1.24 | 20 | Comp. Ex. |
| 20 | 0.88 | 2 | 10 | 1.02 | 20 | Ex. |
| 21 | 0.82 | 6 | 15 | 1.04 | 20 | Ex. |
| 22 | 0.82 | 6 | 11 | 1.04 | 20 | Ex. |
| 23 | 0.82 | 2 | 5 | 1.02 | 20 | Ex. |
| 24 | 0.82 | 2 | 5 | 1.02 | 20 | Ex. |
| 25 | 0.8 | 3 | 11 | 1.04 | 20 | Ex. |
| 26 | 0.8 | 0 | 5 | 10.2 | 20 | Ex. |
| 27 | 0.8 | 0 | 2 | 1.02 | 20 | Ex. |
| 28 | 0.8 | 0 | 2 | 1.02 | 20 | Ex. |
| 29 | 0.55 | 2 | 8 | 1.03 | 60 | Comp. Ex. |
| 30 | 0.55 | 0 | 2 | 1.02 | 60 | Comp. Ex. |
| 31 | 0.55 | 0 | 2 | 1.02 | 60 | Comp. Ex. |
| 32 | 0.55 | 0 | 2 | 1.02 | 60 | Comp. Ex. |

The invention claimed is:

1. A grain-oriented electrical steel sheet comprising:

a steel substrate;

a forsterite film on a surface of the steel substrate; and a Cr-depleted layer at a boundary between the steel substrate and the forsterite film, the Cr-depleted layer having a Cr concentration that is 0.70 times to 0.90 times a Cr concentration of the steel substrate, wherein the steel substrate contains Cr: 0.01 mass % or more and 0.25 mass % or less.

2. The grain-oriented electrical steel sheet according to claim 1, wherein the steel substrate contains Cr: 0.02 mass % or more and 0.20 mass % or less.

3. The grain-oriented electrical steel sheet according to claim 1, wherein the steel substrate contains Cr: 0.15 mass % or more and 0.25 mass % or less.

4. The grain-oriented electrical steel sheet according to claim 1, wherein the steel substrate contains C: 0.08 mass % or less.

5. The grain-oriented electrical steel sheet according to claim 1, wherein the steel substrate contains Si: 2.0 mass % to 8.0 mass %.

6. The grain-oriented electrical steel sheet according to claim 1, wherein the steel substrate contains Mn: 0.005 mass % to 1.000 mass %.

7. A method for manufacturing the grain-oriented electrical steel sheet of claim 1, the method comprising:

subjecting a grain-oriented electrical steel slab to hot rolling, to obtain a hot-rolled steel sheet;

subjecting the hot-rolled steel sheet to cold rolling either once, or twice or more with intermediate annealing performed therebetween, to obtain a cold-rolled steel sheet having a final sheet thickness;

subjecting the cold-rolled steel sheet to decarburization annealing to obtain a decarburization-annealed steel sheet;

applying an annealing separator composed mainly of MgO to the decarburization-annealed steel sheet;

thereafter subjecting the decarburization-annealed steel sheet in coil form to final annealing to obtain a final-annealed steel sheet comprising a steel substrate and a forsterite film on a surface of the steel substrate; and thereafter forming a tension coating on the final-annealed steel sheet, wherein oxidizability of atmosphere in at least a temperature range of 300° C. to 600° C. in a sheet passing process from after the final annealing to when baking the tension coating is controlled to form, at a boundary between the steel substrate and the forsterite film, a Cr-depleted layer having a Cr concentration that is 0.70 times to 0.90 times a Cr concentration of the steel substrate, wherein the grain-oriented electrical steel slab contains Cr: 0.01 mass % or more and 0.25 mass % or less.

8. The method for manufacturing a grain-oriented electrical steel sheet according to claim 7, wherein after the final annealing and before forming the Cr-depleted layer, the final-annealed steel sheet is passed through a pass line including at least one part that imparts bending in a direction opposite to coil set remaining in the final-annealed steel sheet, and the oxidizability of atmosphere when forming the Cr-depleted layer is controlled to an oxygen partial pressure $P_{O2}$ of 0.01 atm to 0.25 atm.

9. The method for manufacturing a grain-oriented electrical steel sheet according to claim 7, wherein the grain-oriented electrical steel slab contains Cr: 0.02 mass % or more and 0.20 mass % or less.

10. The method for manufacturing a grain-oriented electrical steel sheet according to claim 7, wherein the grain-oriented electrical steel slab contains Cr: 0.15 mass % or more and 0.25 mass % or less.

11. The method for manufacturing a grain-oriented electrical steel sheet according to claim 8, wherein a curvature radius of the bending is 750 mm or less.

12. The method for manufacturing a grain-oriented electrical steel sheet according to claim 8, wherein the grain-oriented electrical steel slab contains Cr: 0.02 mass % or more and 0.20 mass % or less.

13. The method for manufacturing a grain-oriented electrical steel sheet according to claim 11, wherein the grain-oriented electrical steel slab contains Cr: 0.02 mass % or more and 0.20 mass % or less.

* * * * *